US011208849B2

(12) United States Patent
Rahmani et al.

(10) Patent No.: US 11,208,849 B2
(45) Date of Patent: Dec. 28, 2021

(54) DRILL BIT CUTTER ELEMENTS AND DRILL BITS INCLUDING SAME

(71) Applicant: National Oilwell DHT, L.P., Conroe, TX (US)

(72) Inventors: Reza Rahmani, The Woodlands, TX (US); Ryan Basson Graham, The Woodlands, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 0 days.

(21) Appl. No.: 16/673,515

(22) Filed: Nov. 4, 2019

(65) Prior Publication Data

US 2021/0131190 A1 May 6, 2021

(51) Int. Cl.
*E21B 10/567* (2006.01)
*E21B 10/42* (2006.01)

(52) U.S. Cl.
CPC ..... *E21B 10/5673* (2013.01); *E21B 10/42* (2013.01)

(58) Field of Classification Search
CPC .. E21B 10/5673; E21B 10/42; E21B 10/5676; E21B 10/16
See application file for complete search history.

(56) References Cited

U.S. PATENT DOCUMENTS 6,176,333 B1 * 1/2001 Doster ..... E21B 10/52 175/428
6,196,340 B1 3/2001 Jensen et al.
(Continued)

FOREIGN PATENT DOCUMENTS

WO WO-2018166191 A1 * 9/2018 ..... E21B 10/43
WO 2019/128956 A1 7/2019
WO 2020/055882 A1 3/2020

OTHER PUBLICATIONS

PCT/US2020/058587 International Search Report and Written Opinion dated Feb. 2, 2021 (16 p.).

*Primary Examiner* — Carib A Oquendo
(74) *Attorney, Agent, or Firm* — Conley Rose, P.C.

(57) ABSTRACT

A cutter element includes a base portion having a central axis, a first end, and a second end. In addition, the cutter element includes a cutting layer fixably mounted to the first end of the base portion. The cutting layer includes a cutting face distal. The cutting face includes a planar central region centered relative to the central axis and disposed in a plane oriented perpendicular to the central axis. The cutting face also includes a plurality of circumferentially-spaced cutting regions disposed about the planar central region. Each cutting region extends from the planar central region to the radially outer surface of the cutting layer. Each cutting region slopes axially toward the base portion moving radially outward from the planar central region to the radially outer surface of the cutting layer. Further, the cutting face includes a plurality of circumferentially-spaced relief regions disposed about the planar central region. Each relief region extends from the planar central region to the radially outer surface. Each relief region slopes axially toward the base portion moving radially outward from the planar central region to the radially outer surface of the cutting layer. The plurality of cutting regions and the plurality of relief regions are circumferentially arranged in an alternating manner such that one relief region is circumferentially disposed two circumferentially adjacent cutting regions of the plurality of cutting regions.

19 Claims, 17 Drawing Sheets

(56) References Cited

U.S. PATENT DOCUMENTS

| | | | | |
|---|---|---|---|---|
| 7,726,420 | B2 * | 6/2010 | Shen | E21B 10/5673 175/430 |
| 7,743,855 | B2 | 6/2010 | Moss | |
| 2012/0247834 | A1 * | 10/2012 | Buxbaum | E21B 10/5673 175/57 |
| 2013/0068537 | A1 | 3/2013 | DiGiovanni | |
| 2014/0366456 | A1 | 12/2014 | Chapman et al. | |
| 2015/0259988 | A1 * | 9/2015 | Chen | E21B 10/5673 175/430 |
| 2019/0040689 | A1 * | 2/2019 | Liang | E21B 10/42 |
| 2019/0106943 | A1 * | 4/2019 | Tilleman | E21B 10/5673 |
| 2019/0203539 | A1 * | 7/2019 | Zhao | E21B 10/5673 |
| 2019/0368277 | A1 * | 12/2019 | Zhao | C04B 35/528 |
| 2020/0224501 | A1 * | 7/2020 | Dubose | E21B 10/5673 |

* cited by examiner

DRILL BIT CUTTER ELEMENTS AND DRILL BITS INCLUDING SAME

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The disclosure relates generally to drill bits for drilling a borehole in an earthen formation for the ultimate recovery of oil, gas, or minerals. More particularly, the disclosure relates to fixed cutter bits and cutter elements used on such bits.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Fixed cutter bits, also known as rotary drag bits, are one type of drill bit commonly used to drill boreholes. Fixed cutter bit designs include a plurality of blades angularly spaced about the bit face. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PCD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, the phrase "polycrystalline diamond cutter" or "PDC" may be used to refer to a fixed cutter bit ("PDC bit") or cutter element ("PDC cutter element") employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thereby reducing the effective cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutter elements in order to prolong cutter element life. Thus, the number and placement of drilling fluid nozzles, and the resulting flow of drilling fluid, may significantly impact the performance of the drill bit.

Without regard to the type of bit, the cost of drilling a borehole for recovery of hydrocarbons may be very high and is proportional to the length of time it takes to drill to the desired depth and location. The time required to drill the well, in turn, is greatly affected by the cutting efficiency and durability of the cutting structure on the drill bit.

BRIEF SUMMARY OF THE DISCLOSURE

Embodiments of cutter elements for drill bits configured to drill boreholes in subterranean formations are disclosed herein. In one embodiment, the cutter element comprises a base portion having a central axis, a first end, a second end, and a radially outer surface extending axially from the first end to the second end. In addition, the cutter element comprises a cutting layer fixably mounted to the first end of the base portion. The cutting layer includes a cutting face distal the base portion and a radially outer surface extending axially from the cutting face to the radially outer surface of the base portion. The cutting face comprises a planar central region centered relative to the central axis and disposed in a plane oriented perpendicular to the central axis. The cutting face also comprises a plurality of circumferentially-spaced cutting regions disposed about the planar central region. Each cutting region extends from the planar central region to the radially outer surface of the cutting layer. Each cutting region slopes axially toward the base portion moving radially outward from the planar central region to the radially outer surface of the cutting layer. Further, the cutting face comprises a plurality of circumferentially-spaced relief regions disposed about the planar central region. Each relief region extends from the planar central region to the radially outer surface. Each relief region slopes axially toward the base portion moving radially outward from the planar central region to the radially outer surface of the cutting layer. The plurality of cutting regions and the plurality of relief regions are circumferentially arranged in an alternating manner such that one relief region is circumferentially disposed two circumferentially adjacent cutting regions of the plurality of cutting regions.

In another embodiment, a cutter element comprises a base portion having a central axis, a first end, a second end, and a radially outer surface extending axially from the first end to the second end. In addition, the cutter element comprises a cutting layer fixably mounted to the first end of the base portion. The cutting layer includes a cutting face distal the base portion and a radially outer surface extending axially from the cutting face to the radially outer surface of the base portion. The cutting face comprises a planar central region disposed in a plane oriented perpendicular to the central axis. The cutting face also comprises a plurality of circumferentially-spaced cutting ridges disposed about the planar central region. Each cutting ridge comprises a planar surface extending radially outward from the planar central region. The planar surface of each cutting ridge is disposed at an acute angle β measured upward from the planar surface to the plane containing the planar central region. An end of each cutting ridge radially distal the planar central region comprises a cutting edge configured to engage and shear the subterranean formation. Further, the cutting face comprises a plurality of circumferentially-spaced relief regions disposed about the planar central region. Each relief region extends from the planar central region. Each relief region slopes axially toward the base portion moving radially outward from the planar central region. One cutting ridge is circumferentially disposed between a pair of the circumferentially adjacent relief regions.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
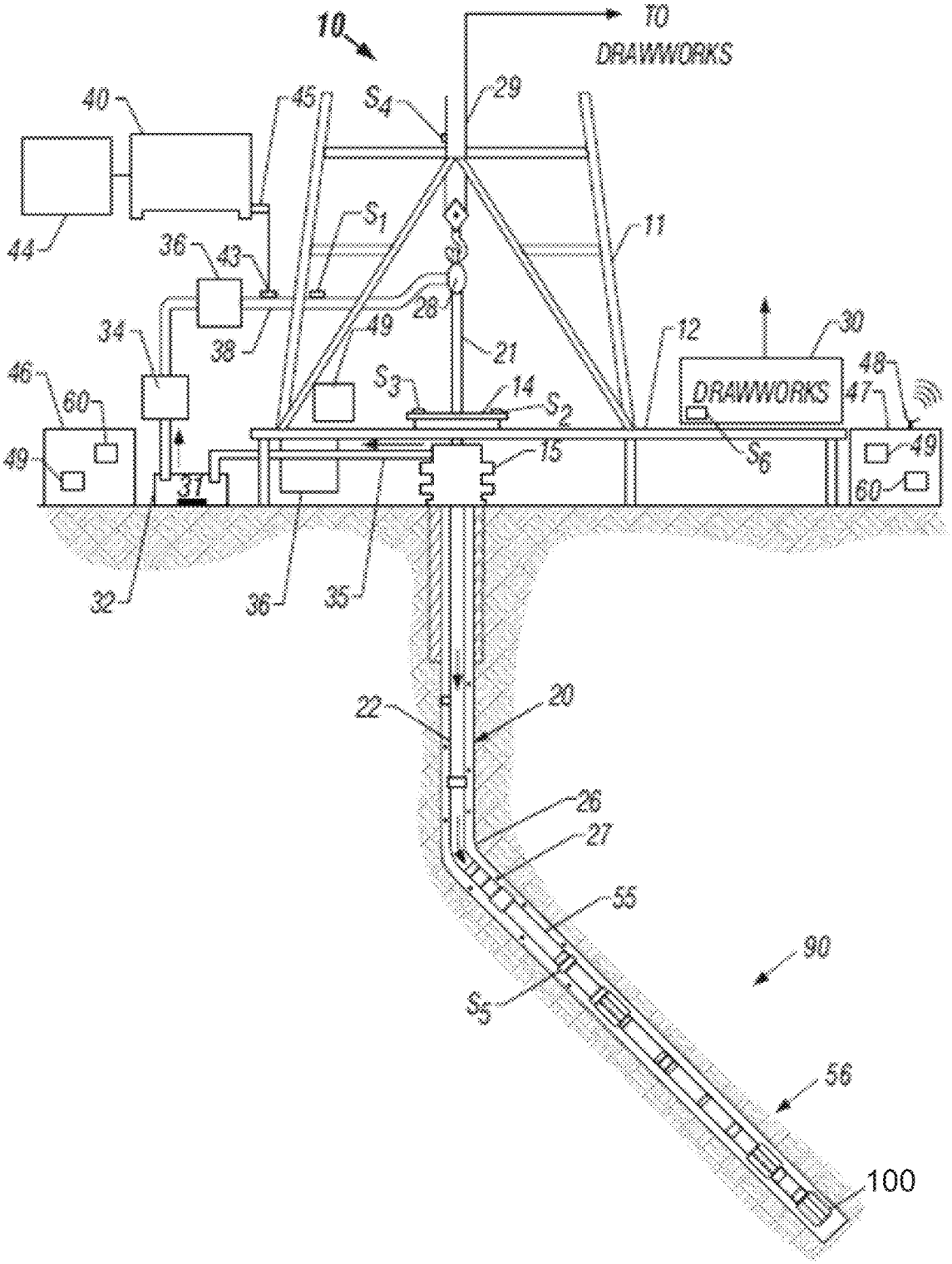
FIG. 1 is a schematic view of a drilling system including an embodiment of a drill bit with a plurality of cutter elements in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purposes of clarity, with "up", "upper", "upwardly" or "upstream" meaning toward the surface of the borehole and with "down", "lower", "downwardly" or "downstream" meaning toward the terminal end of the borehole, regardless of the borehole orientation.

As previously described, the length of time it takes to drill to the desired depth and location impacts the cost of drilling operations. The shape and positioning of the cutter elements impact bit durability and rate of penetration (ROP) and thus, are important to the success of a particular bit design. Embodiments described herein are directed to cutter elements for fixed cutter drill bits with geometries that offer the potential to improve bit durability and/or ROP. In some embodiments, cutter elements disclosed herein can be reused one or more times after the initial cutting edge is sufficiently worn, which offers the potential to enhance the useful life of such cutter elements.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 and/or a top drive, rotated by downhole mud motor 55 disposed along drillstring 20 proximal bit 100, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
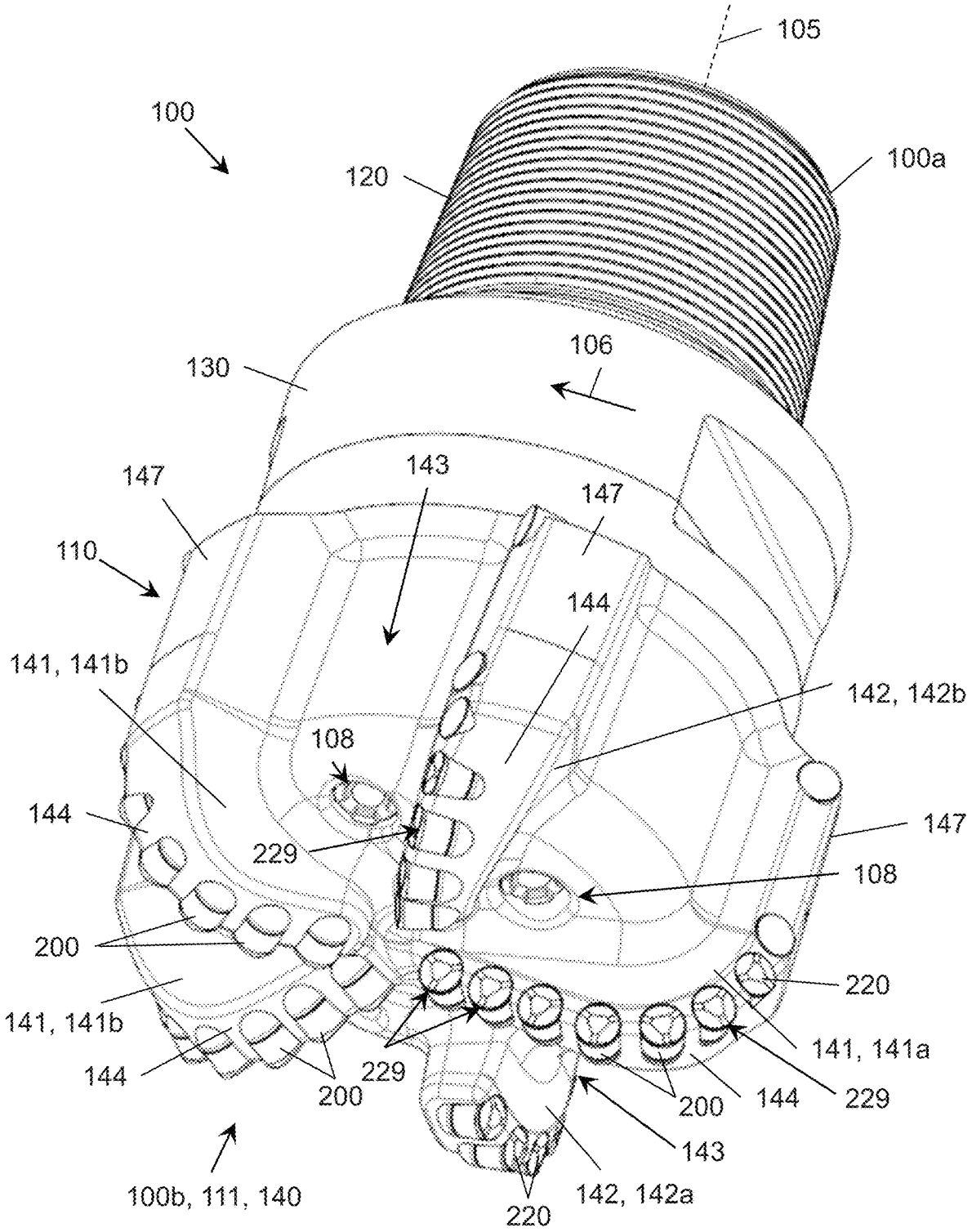
FIG. 2 is a perspective view of the drill bit of FIG. 1.
Figure 3:
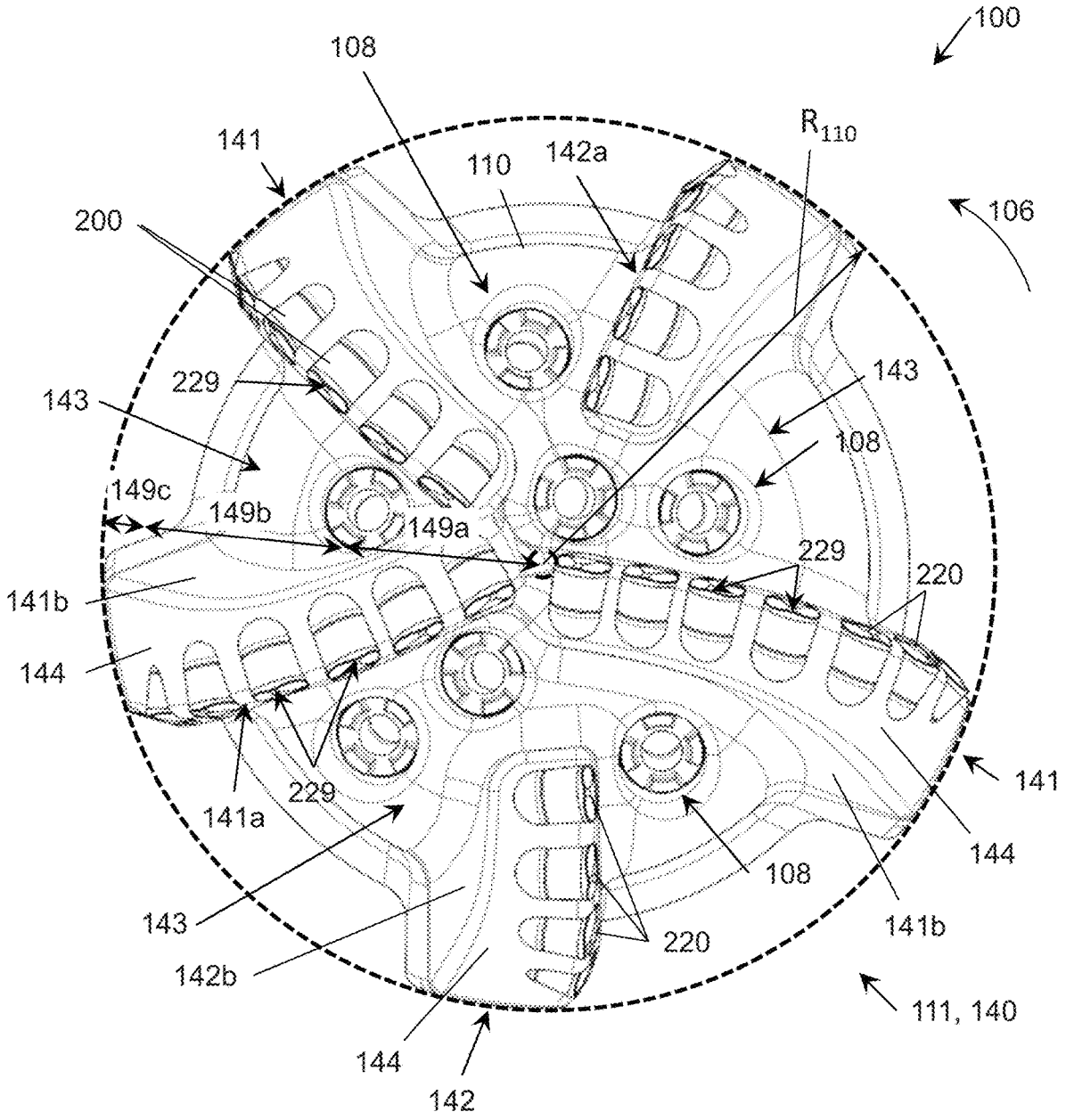
FIG. 3 is a face or bottom end view of the drill bit of FIG. 2.

Referring now to FIGS. 2 and 3, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by arrow 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to drill string 20, which is employed to rotate the bit 100 to drill the borehole 26. Bit body 110, shank 130, and pin 120 are coaxially aligned with axis 105, and thus, each has a central axis coincident with axis 105.

The portion of bit body 110 that faces the formation at downhole end 100*b* includes a bit face 111 provided with a cutting structure 140. Cutting structure 140 includes a plurality of blades 141, 142, which extend from bit face 111. In this embodiment, cutting structure 140 includes three angularly spaced-apart primary blades 141, and three angularly spaced apart secondary blades 142. Further, in this embodiment, the plurality of blades (e.g., primary blades 141, and secondary blades 142) are uniformly angularly spaced on bit face 111 about bit axis 105. In this embodiment, bit 100 includes five total blades 141, 142—three primary blades 141 and two secondary blades 142. The five blades 141, 142 are uniformly angularly spaced about 72° apart. In other embodiments, the blades (e.g., blades 141, 142 may be non-uniformly circumferentially spaced about bit face 111). Although bit 100 is shown as having three primary blades 141 and two secondary blades 142, in other embodiments, the bit (e.g., bit 100) may comprise any suitable number of primary and secondary blades such as two primary blades and four secondary blades or three primary blades and three secondary blades.

In this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses 143. Each blade 141, 142 has a leading edge or side 141*a*, 142*a*, respectively, and a trailing edge or side 141*b*, 142*b*, respectively, relative to the direction of rotation 106 of bit 100.

Referring still to FIGS. 2 and 3, each blade 141, 142 includes a cutter-supporting surface 144 for mounting a plurality of cutter elements 200. In particular, cutter elements 200 are arranged adjacent one another in a radially extending row proximal the leading edge of each primary blade 141 and each secondary blade 142. In this embodiment, each cutter element 200 has substantially the same size and geometry, which will be described in more detail below.

As will also be described in more detail below, each cutter element 200 has a cutting face 220. In the embodiments described herein, each cutter element 200 is mounted such that its cutting face 220 is generally forward-facing. As used herein, "forward-facing" is used to describe the orientation of a surface that is substantially perpendicular to, or at an acute angle relative to, the cutting direction of the bit (e.g., cutting direction 106 of bit 100).

Referring still to FIGS. 2 and 3, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when cutter elements 200 wear slightly under gage. Gage pads 147 also help stabilize bit 100 against vibration.

Figure 4:
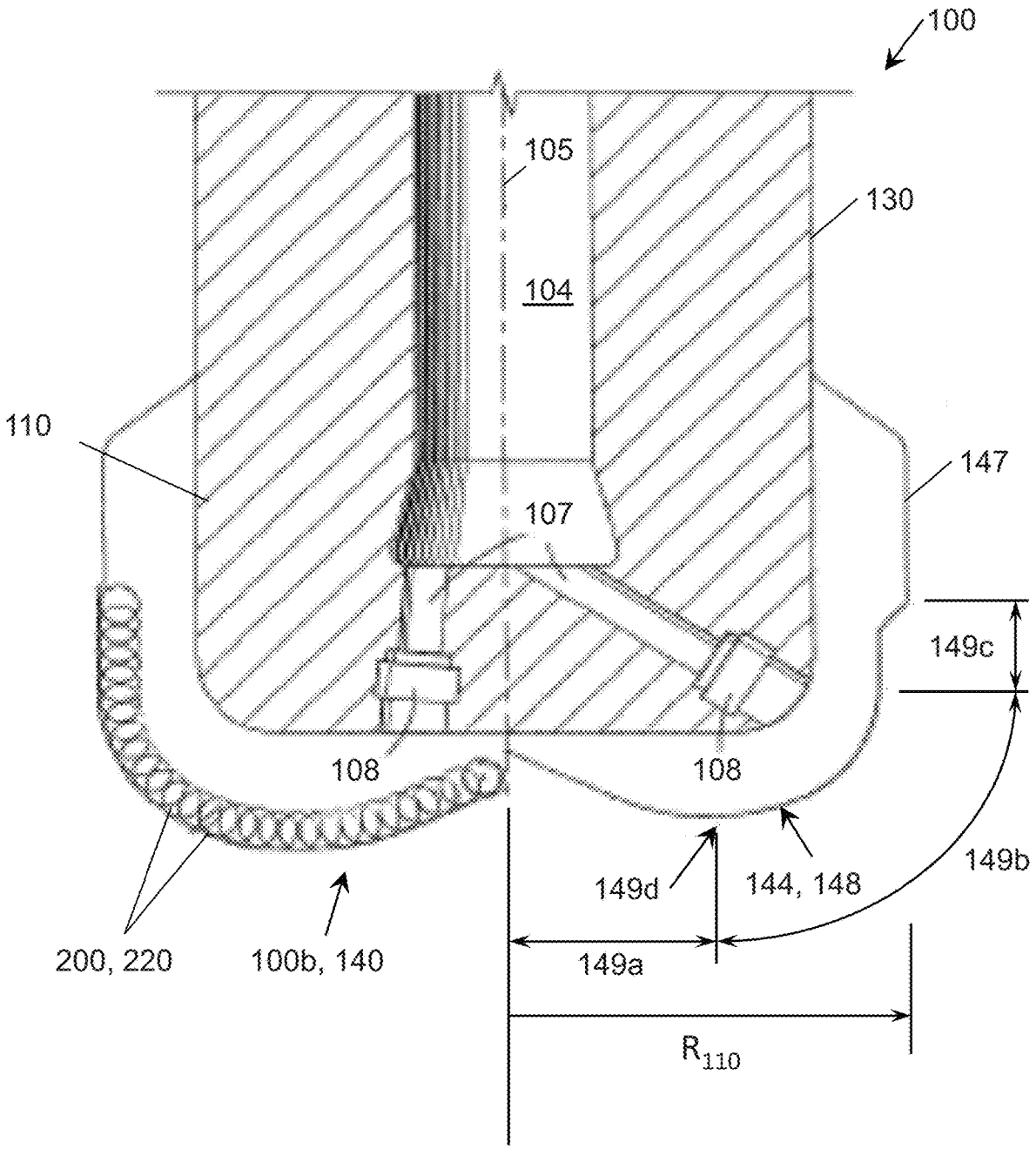
FIG. 4 is a partial cross-sectional view of the bit shown in FIG. 2 with the blades and the cutting faces of the cutter elements rotated into a single composite profile.

Referring now to FIG. 4, an exemplary profile of bit body 110 is shown as it would appear with blades 141, 142 and cutting faces 220 rotated into a single rotated profile. In rotated profile view, blades 141, 142 of bit body 110 form a combined or composite blade profile 148 generally defined by cutter-supporting surfaces 144 of blades 141, 142. In this embodiment, the profiles of surfaces 144 of blades 141, 142 are generally coincident with each other, thereby forming a single composite blade profile 148.

Composite blade profile 148 and bit face 111 may generally be divided into three regions conventionally labeled cone region 149*a*, shoulder region 149*b*, and gage region 149*c*. Cone region 149*a* defines the radially innermost region of bit body 110 and composite blade profile 148, and extends from bit axis 105 to shoulder region 149*b*. In this embodiment, cone region 149*a* is generally concave. Adjacent cone region 149*a* is the generally convex shoulder region 149*b*. The transition between cone region 149*a* and shoulder region 149*b*, typically referred to as the nose 149*d*, occurs at the axially lowermost/outermost portion of composite blade profile 148 where a tangent line to the blade profile 148 has a slope of zero. Moving radially outward, adjacent shoulder region 149*b* is the gage region 149*c* which extends substantially parallel to bit axis 105 at the outer radial periphery of composite blade profile 148. As shown in composite blade profile 148, gage pads 147 define the gage region 149*c* and the outer radius $R_{110}$ of bit body 110. Outer radius $R_{110}$ extends to and therefore defines the full gage diameter of bit body 110. As used herein, the term "full gage diameter" refers to elements or surfaces extending to the full, nominal gage of the bit diameter.

Referring now to FIGS. 3 and 4, moving radially outward from bit axis 105, bit face 111 includes cone region 149*a*, shoulder region 149*b*, and gage region 149*c* as previously described. Primary blades 141 extend radially along bit face 111 from within cone region 149*a* proximal bit axis 105 toward gage region 149*c* and outer radius $R_{110}$. Secondary blades 142 extend radially along bit face 111 from proximal nose 149*d* toward gage region 149*c* and outer radius $R_{110}$. Thus, in this embodiment, each primary blade 141 and each secondary blade 142 extends substantially to gage region 149*c* and outer radius $R_{110}$. In this embodiment, secondary blades 142 do not extend into cone region 149*a*, and thus, secondary blades 142 occupy no space on bit face 111 within cone region 149*a*. Although a specific embodiment of bit 100 and corresponding bit body 110 has been shown in described, one skilled in the art will appreciate that numerous variations in the size, orientation, and locations of the blades (e.g., primary blades 141, secondary blades, 142, etc.), and cutter elements (e.g., cutter elements 200) are possible.

As best shown in FIG. 4, bit 100 includes an internal plenum 104 extending axially from uphole end 100*a* through pin 120 and shank 130 into bit body 110. Plenum 104 permits drilling fluid to flow from the drill string 20 into bit 100. Body 110 is also provided with a plurality of flow passages 107 extending from plenum 104 to downhole end 100*b*. A nozzle 108 is seated in the lower end of each flow passage 107. Together, passages 107 and nozzles 108 distribute drilling fluid around cutting structure 140 to flush away formation cuttings and to remove heat from cutting structure 140, and more particularly cutting elements 200, during drilling.

Referring now to FIGS. 5A-5D, one cutter element 200 is shown. Although only one cutter element 200 is shown in FIGS. 5A-5D, it is to be understood that all cutter elements 200 of bit 100 are the same. In general, bit 100 may include any number of cutter elements 200, and further, cutter elements 200 can be used in connection with different cutter elements (e.g., cutter elements having geometries different than cutter element 200) on the same bit (e.g., bit 100).

In this embodiment, cutter element 200 includes a base or substrate 201 and a cutting disc or layer 210 bonded to the substrate 201. Cutting layer 210 and substrate 201 meet at a reference plane of intersection 209 that defines the location at which substrate 201 and cutting layer 210 are fixably attached. In this embodiment, substrate 210 is made of tungsten carbide and cutting layer 210 is made of an ultrahard material such as polycrystalline diamond (PCD) or other superabrasive material. Part and/or all of the diamond in cutting layer 210 may be leached, finished, polished, and/or otherwise treated to enhance durability, efficiency and/or effectiveness. While cutting layer 210 is shown as a single layer of material mounted to substrate 210, in general, the cutting layer (e.g., layer 210) may be formed of one or more layers of one or more materials. In addition, although substrate 201 is shown as a single, homogenous material, in general, the substrate (e.g., substrate 201) may be formed of one or more layers of one or more materials.

Figure 5A:
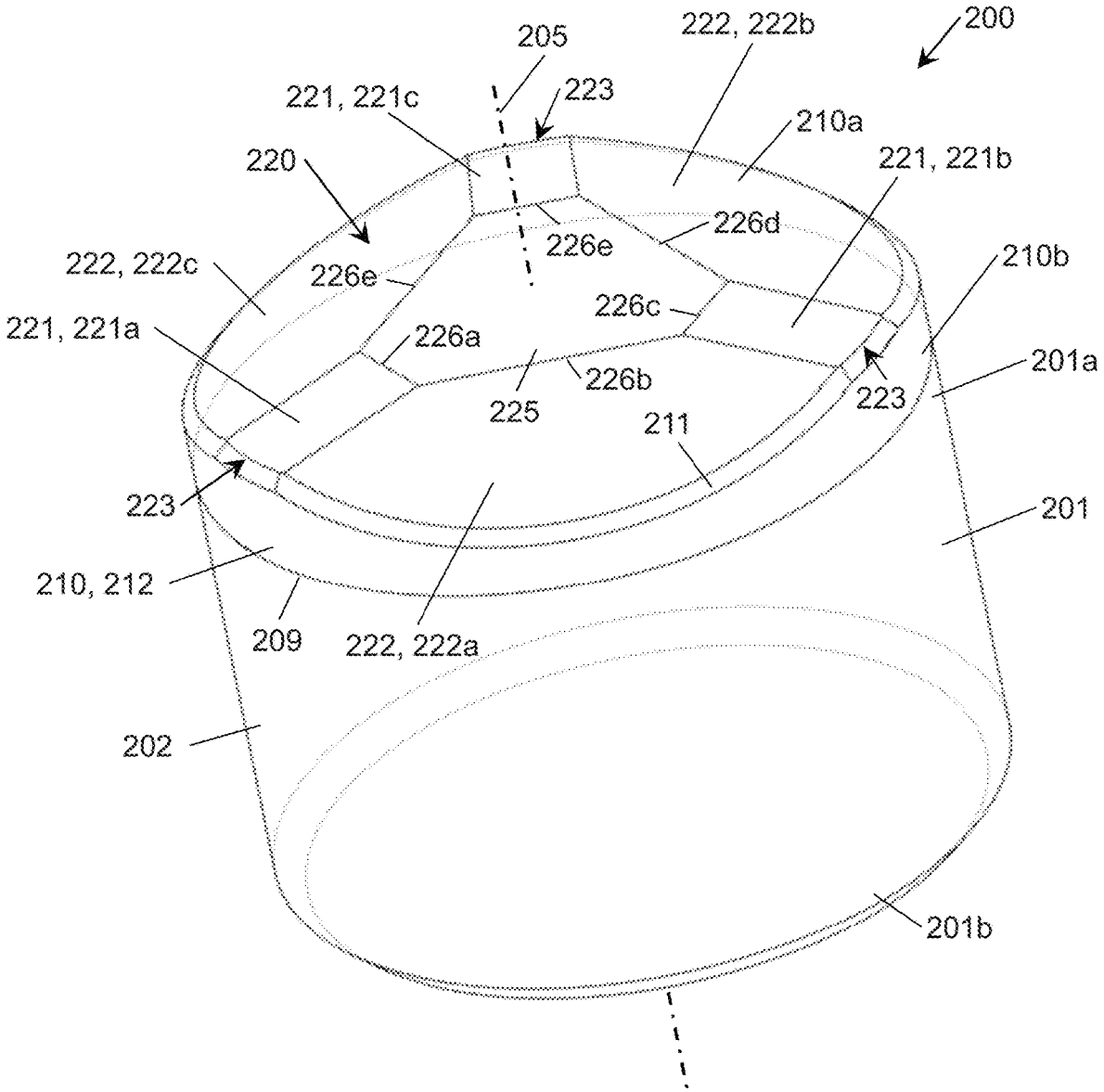
FIGS. 5A-5D are perspective, top, rear side, and lateral side views, respectively, of one of the cutter elements of the drill bit of FIG. 2.

Substrate 201 has a central axis 205, a first end 201*a* bonded to cutting layer 210 at plane of intersection 209, a second end 201*b* opposite end 201*a* and distal cutting layer 210, and a radially outer surface 202 extending axially between ends 201*a*, 201*b*. In this embodiment, substrate 201 is generally cylindrical, and thus, outer surface 202 is generally cylindrical. As best shown in FIGS. 5A, 5C, and 5D, end 201*b* comprises an annular chamfer or bevel extending about the entire circumference of substrate 201 in this embodiment.

Referring still to FIGS. 5A-5D, cutting layer 210 has a first end 210*a* distal substrate 201, a second end 210*b* bonded to end 201*a* of substrate 201 at plane of intersection 209, and a radially outer surface 212 extending axially between ends 210*a*, 210*b*. In this embodiment, cutting layer 210 is generally disc-shaped, and thus, outer surface 212 is generally cylindrical. In addition, outer surfaces 202, 212 are coextensive and contiguous such that there is a generally smooth transition moving axially between outer surfaces 202, 212.

The outer surface of cutting layer 210 at first end 210*a* defines the cutting face 220 of cutter element 200 and is designed and shaped to engage and shear the formation during drilling operations. In this embodiment, a chamfer or bevel 211 is provided at the intersection of cutting face 220 and outer surface 212 about the entire outer periphery of cutting face 220.

Figure 5B:
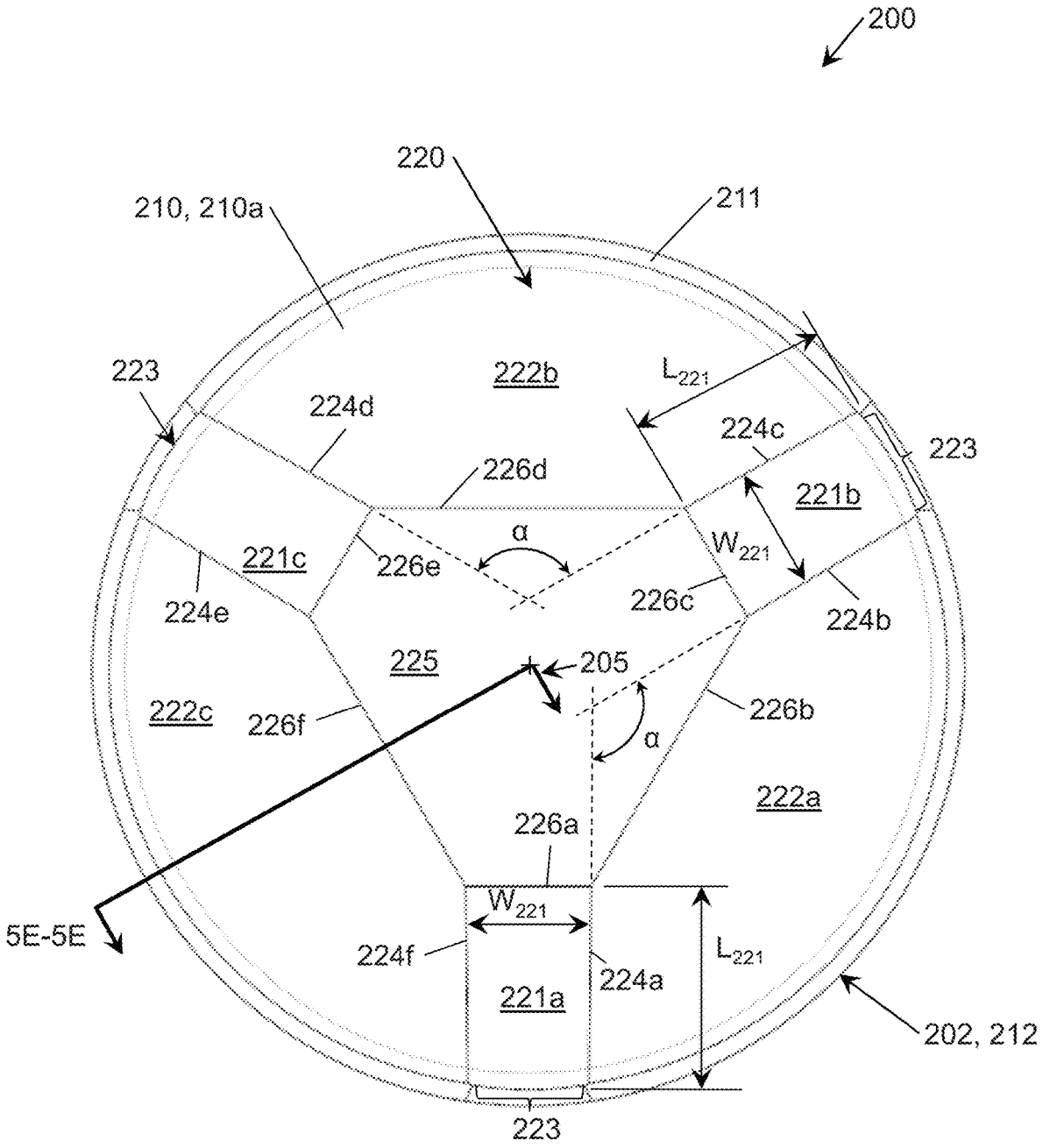
Figure 5C:
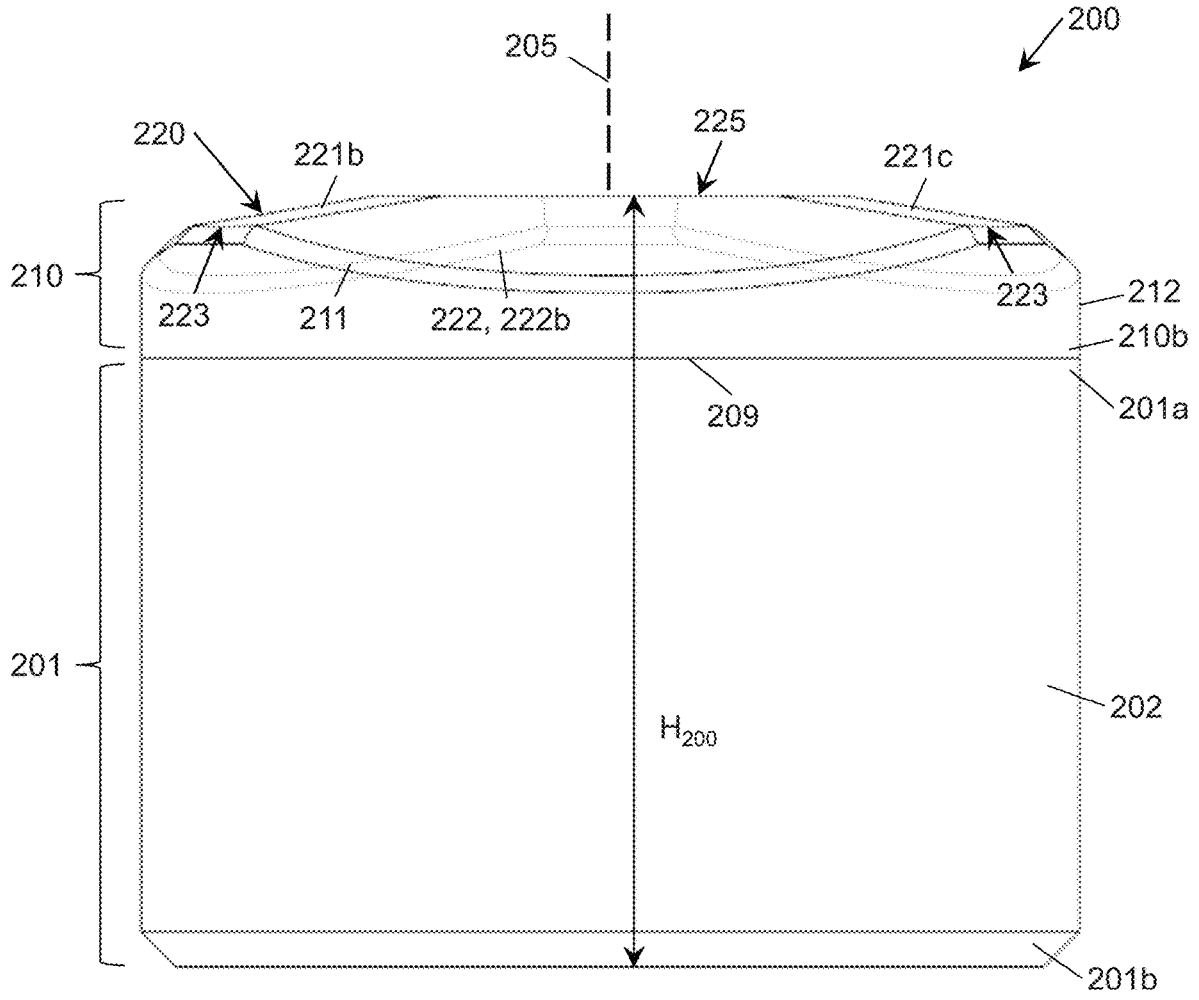
Figure 5D:
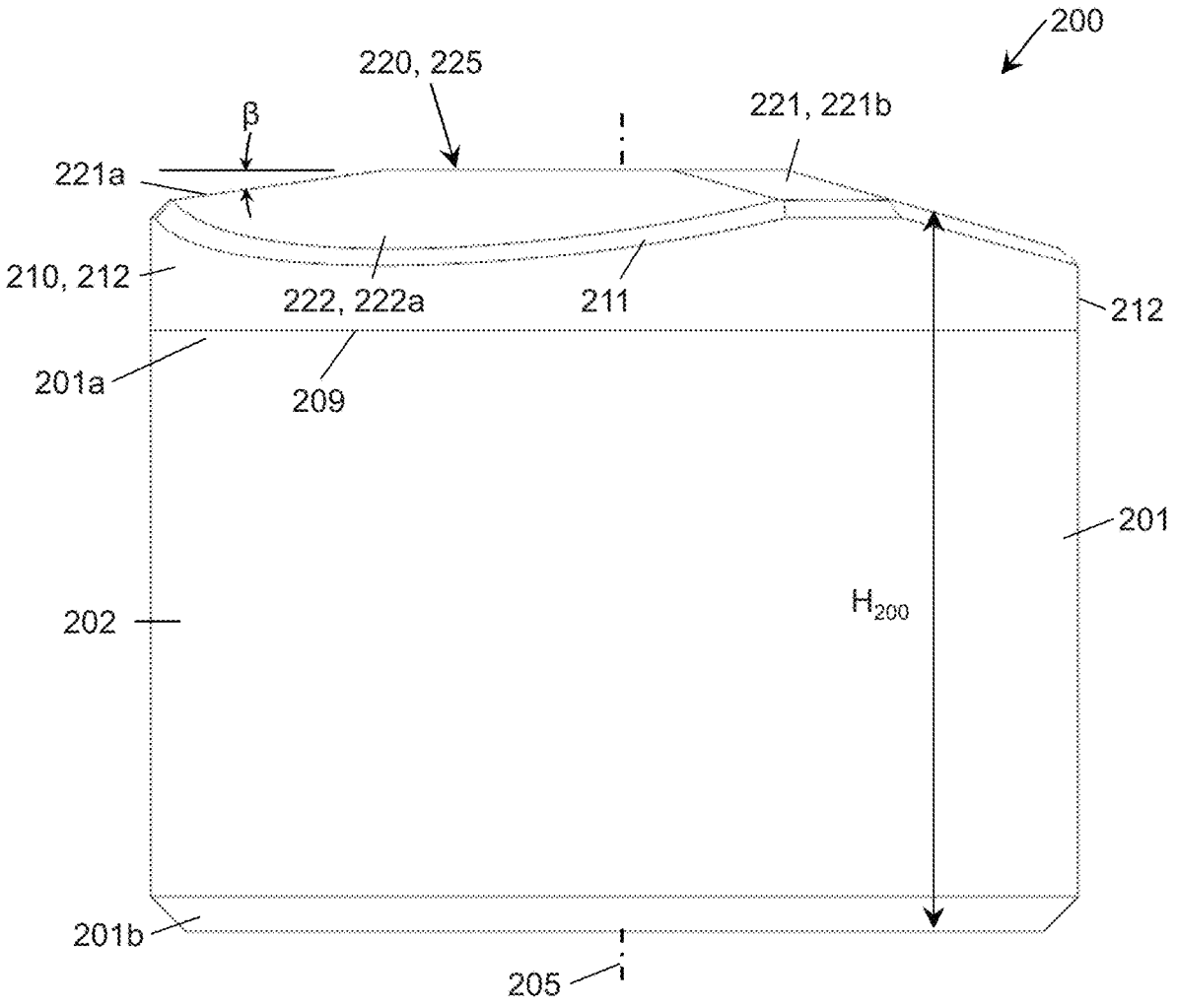

As best shown in the top view of cutter element 200 in FIG. 5B (looking at cutting face 220 as viewed parallel to central axis 205), in this embodiment, cutting face 220 is generally symmetric about central axis 205. In particular, cutting face 220 is generally convex or bowed outward in the side view (front, rear, and lateral side views) as shown in FIGS. 5C and 5D for example. In addition, in this embodiment, cutting face 220 is defined by a plurality of discrete regions or surfaces that intersect at linear boundaries or edges. More specifically, as best shown in FIGS. 5A and 5B, cutting face 220 includes a central region or surface 225, a plurality of uniformly circumferentially-spaced a cutting regions or surfaces 221 extending radially from central region 225 to outer surface 212 and chamfer 211, and a plurality of uniformly circumferentially-spaced relief regions or surfaces 222 extending from central region 225 and cutting regions 221 to outer surface 212 and chamfer 211. Regions 221, 222 are circumferentially disposed about axis 205 and central region 225. In addition, regions 221, 222 are arranged in an circumferentially alternating manner such that regions 221, 222 are positioned circumferentially adjacent each other with each region 221 circumferentially disposed between a pair of circumferentially-adjacent regions 222, and each region 222 circumferentially disposed between a pair of circumferentially-adjacent regions 221. Consequently, the number of cutting regions 221 and the number of relief regions 222 is the same. In this embodiment, cutting face 220 includes three cutting regions 221 and three relief regions 222. However, in other embodiments, more than three cutting regions (e.g., regions 221) and more than three relief regions (e.g., regions 222) may be provided it being understood that the number of cutting regions and relief regions is the same (e.g., five cutting regions and five relief regions, six cutting regions and six relief regions, etc.). As cutting face 220 includes three uniformly circumferentially spaced cutting regions 221 and three uniformly circumferentially-spaced relief regions 222, in this embodiment, the radial centerlines of cutting regions 221 are angularly spaced 120° apart about axis 205 and the radial centerlines of relief regions 222 are angularly spaced 120° apart about axis 205. In this embodiment, each cutting region 221 has the same geometry and each relief region 222 has the same geometry. Due to the uniform spacing of regions 221 and regions 222, and uniformity of geometry of regions 221 and regions 222, the radial centerline of each region 221, 222 is disposed in a plane containing central axis 205.

For purposes of clarity and further explanation, the three cutting regions 221 of cutting face 220 are labeled 221*a*, 221*b*, 221*c* and the three relief regions 222 of cutting face 220 are labeled 222*a*, 222*b*, 222*c*. As previously described, regions 221, 222 are arranged in an circumferentially alternating manner such that regions 221, 222 are positioned circumferentially adjacent each other with each region 221 circumferentially disposed between a pair of circumferentially-adjacent regions 222, and each region 222 circumferentially disposed between a pair of circumferentially-adjacent regions 221. More specifically, relief region 222*a* extends circumferentially from cutting region 221*a* to cutting region 221*b*, relief region 222*b* extends circumferentially from cutting region 221*b* to cutting region 221*c*, and relief region 222*c* extends circumferentially from cutting region 221*c* to cutting region 221*a*. Thus, each cutting region 221*a*, 221*b*, 221*c* extends circumferentially between a pair of circumferentially adjacent regions 222*a*, 222*b*, 222*c*, and each relief region 222*a*, 222*b*, 222*c* extends circumferentially between a pair of circumferentially adjacent cutting regions 221*a*, 221*b*, 221*c*.

As best shown in FIG. 5B, a linear boundary or edge is provided at the intersection of each circumferentially adjacent region 221, 222, and a linear boundary or edge is provided at the intersection of central region 225 and each region 221, 222. In particular, regions 221*a*, 222*a* intersect at a linear edge 224*a*, regions 222*a*, 221*b* intersect at a linear edge 224*b*, regions 221*b*, 222*b* intersect at a linear edge 224*c*, regions 222*b*, 221*c* intersect at a linear edge 224*d*, regions 221*c*, 222*c* intersect at a linear edge 224*e*, and regions 222*c*, 221*a* intersect at a linear edge 224*f*. Thus, region 221*a* may be described as extending circumferentially between edges 224*a*, 224*f*, region 222*a* may be described as extending circumferentially between edges 224*a*, 224*b*, region 221*b* may be described as extending circumferentially between edges 224*b*, 224*c*, region 222*b* may be described as extending circumferentially between edges 224*c*, 224*d*, region 221*c* may be described as extending circumferentially between edges 224*d*, and 224*e*, region 222*c* may be described as extending circumferentially between edges 224*e*, 224*f*. In addition, regions 225, 221*a* intersect at a linear edge 226*a*, regions 225, 222*a* intersect at a linear edge 226*b*, regions 225, 221*b* intersect at a linear edge 226*c*, regions 225, 222*b* intersect at a linear edge 226*d*, regions 225, 221*c* intersect at a linear edge 226*e*, and regions 225, 222*c* intersect at a linear edge 226*f*. Linear edges 226*a*, 226*b*, 226*c*, 226*d*, 226*e*, 226*f* are connected end-to-end to form the closed polygon that defines central region 225 as will be described in more detail below.

As previously described, in this embodiment, cutting regions 221*a*, 221*b*, 221*c* intersect central region 225 at defined linear edges 226*a*, 226*c*, 226*e*, relief regions 222*a*, 222*b*, 222*c* intersect central region 225 at defined linear edges 226*b*, 226*d*, 226*f*, and cutting regions 221*a*, 221*b*, 221*c* intersect relief regions 222*a*, 222*b*, 222*c* at defined linear edges 224*a*, 224*b*, 224*c*, 224*d*, 224*e*, 224*f*. However, in other embodiments, the cutting regions (e.g., cutting regions 221*a*, 221*b*, 221*c*) may intersect the central region (e.g., central region 225) at smoothly curved, continuously contoured surfaces, the relief regions (e.g., relief regions 222*a*, 222*b*, 222*c*) may intersect the central region at smoothly curved, continuously contoured surfaces, the cutting regions may intersect the relief regions at smoothly curved, continuously contoured surfaces, or combinations thereof.

Each linear edge 224*a*, 224*b*, 224*c*, 224*d*, 224*e*, 224*f* extends generally radially from central region 225 to outer surface 212 and chamfer 211. In this embodiment, linear edges 224*a*, 224*f* are parallel to each other moving radially along cutting region 221*a* from central region 225 to outer surface 212 and chamfer 211, linear edges 224*b*, 224*c* are parallel to each other moving radially along cutting region 221*b* from central region 225 to outer surface 212 and chamfer 211, and linear edges 224*d*, 224*e* are parallel to each other moving radially along cutting region 221*c* from central region 225 to outer surface 212 and chamfer 211. In contrast, linear edges 224*a*, 224*b* defining the circumferential ends of relief region 222*a* slope or taper away from each other moving radially along relief region 222*a* from central region 225 to outer surface 212 and chamfer 211, linear edges 224*c*, 224*d* defining the circumferential ends of relief region 222*b* slope or taper away from each other moving radially along relief region 222*b* from central region 225 to outer surface 212 and chamfer 211, and linear edges 224*e*, 224*f* defining the circumferential ends of relief region 222*c* slope or taper away from each other moving radially along relief region 222*c* from central region 225 to outer surface 212 and chamfer 211. Consequently, each pair of linear edges 224*a*, 224*b*, 224*c*, 224*d*, 224*e*, 224*f* defining the circumferential ends of relief regions 222*a*, 222*b*, 222*c* are oriented at an angle $\alpha$ relative to each other in top view. The angle $\alpha$ between linear edges 224*a*, 224*b*, the angle $\alpha$ between linear edges 224*c*, 224*d*, and the angle $\alpha$ between linear edges 224*e*, 224*f* are each preferably between 45° and 75°, and more preferably between 55° and 65°. In this embodiment, each angle $\alpha$ is 60°. It should be appreciated that as the number of relief regions (e.g., relief regions 222*a*, 222*b*, 222*c*) increase, the angle $\alpha$ associated with each relief region may decrease; and as the number of relief regions decreases, the angle $\alpha$ associated with each relief region may increase.

Referring still to FIG. 5B, each cutting region 221*a*, 221*b*, 221*c* has a width $W_{221}$ measured perpendicularly from one edge 224*f*, 224*b*, 224*d* of the region 221*a*, 221*b*, 221*c*, respectively, to the other edge 224*f*, 224*c*, 224*e* of the region 221*a*, 221*b*, 221*c*, respectively, in top view. Since edges 224*f*, 224*a* of cutting region 221*a* are parallel, edges 224*b*, 224*c* of cutting region 221*b* are parallel, and edges 224*d*, 224*e* of cutting region 221*c* are parallel, the width $W_{221}$ of each cutting region 221*a*, 221*b*, 221*c* is uniform or constant moving radially along the region 221*a*, 221*b*, 221*c*, respectively, from central region 225 to outer surface 212 and chamfer 211. In this embodiment, the circumferential width of each relief region 222*a*, 222*b*, 222*c* is greater than the width $W_{221}$ of each cutting region 221*a*, 221*b*, 221*c*, and thus, the length of each edge 226*b*, 226*d*, 226*f* is greater than the length of each edge 226*a*, 226*c*, 226*e*. In embodiments described herein, the width $W_{221}$ of each cutting region 221*a*, 221*b*, 221*c* is preferably ranges from 1.0 mm to 5.0 mm, and more preferably ranges from 1.0 mm to 2.0 mm; and the ratio of the width $W_{221}$ of each cutting region 221*a*, 221*b*, 221*c* to the diameter of cutter element 200 preferably ranges from 0.05 to 0.50, and more preferably ranges from 0.10 to 0.17. In addition, each cutting region 221*a*, 221*b*, 221*c* has a length $L_{221}$ measured radially and perpendicular to edge 226*a*, 226*c*, 226*e*, respectively, from the central region 225 and the corresponding edge 226*a*, 226*c*, 226*e* to outer surface 212 and chamfer 211. In embodiments described herein, the ratio of the length $L_{221}$ of each cutting region 221*a*, 221*b*, 221*c* to the diameter of the cutting element 200 preferably ranges from 0.0 to 0.5, and more preferably ranges from 0.125 to 0.325. In this embodiment, the ratio of the width $W_{221}$ of each cutting region 221*a*, 221*b*, 221*c* to the diameter of cutter element 200 is 0.14, and the ratio of the length $L_{221}$ of each cutting region 221*a*, 221*b*, 221*c* to the diameter of the cutting element 200 is 0.25.

In this embodiment, the width $W_{221}$ of each cutting region 221*a*, 221*b*, 221*c* is the same and the length $L_{221}$ of each cutting region 221*a*, 221*b*, 221*c* is the same. However, in other embodiments, the width of any two or more cutting regions (e.g., width $W_{221}$ of any two or more cutting regions 221*a*, 221*b*, 221*c*) may be the same or different, the width of any one or more cutting regions may vary moving radially along the cutting region from the central region (e.g., central region 225) to the outer surface (e.g., outer surface 212), the length of any two or more cutting regions (e.g., the width $L_{221}$ of any two or more cutting regions 221*a*, 221*b*, 221*c*) may be the same or different, or combinations thereof.

Referring now to FIGS. 5A and 5B, central region 225 is radially centered on cutting face 220 and centered relative to axis 205. In particular, axis 205 intersects the geometric center of central region 225. In this embodiment, central surface or region 225 is planar, and thus, may also be referred to as a "planar" surface or facet. In addition, in this embodiment, central region 225 is oriented perpendicular to axis 205 and has a polygonal shape defined by the plurality of linear edges 226*a*, 226*b*, 226*c*, 226*d*, 226*e*, 226*f* at the intersection of central region 225 and each region 221*a*, 221*b*, 221*c*, 222*a*, 222*b*, 222*c*, respectively. In this embodiment, the three cutting regions 221*a*, 221*b*, 221*c* and the three relief regions 222*a*, 222*b*, 222*c* define six sides of central region 225 at edges 226*a*, 226*b*, 226*c*, 226*d*, 226*e*, 226*f*, and thus, central region 225 has a hexagonal shape. In general, the number of sides of the polygonal central regions of embodiments described herein (e.g., central region 225) is equal to the number of cutting regions (e.g., cutting regions 221*a*, 221*b*, 221*c*) plus the number of relief regions (e.g., relief regions 222*a*, 222*b*, 222*c*). Although edges 226*a*, 226*b*, 226*c*, 226*d*, 226*e*, 226*f* defining central region 225 are linear in this embodiment of cutting element 200, in other embodiments, the edges defining the central region (e.g., edges 226*a*, 226*b*, 226*c*, 226*d*, 226*e*, 226*f* defining central region 225 are linear in this embodiment of cutting element 200) are concave and bow inwardly toward the central axis of the cutter element (e.g., axis 205). In embodiments described herein, central region 225 is preferably polished to an average roughness Ra of less than 1000 nanometers, and preferably less than 500 nanometers.

Referring again to FIGS. 5A-5D, each cutting region 221*a*, 221*b*, 221*c* extends radially from central region 225 to outer surface 212 and chamfer 211. In this embodiment, each cutting region 221*a*, 221*b*, 221*c* is planar, and thus, may also be referred to as a "planar" surface or facet. In addition, in this embodiment, each cutting region 221*a*, 221*b*, 221*c* slopes axially downward toward base 201 moving radially outward from central region 225 to outer surface 212 and chamfer 211. In particular, as best shown in FIG. 5D, each cutting facet 221*a*, 221*b*, 221*c* is oriented at a non-zero acute angle β measured upward from the cutting facet 221*a*, 221*b*, 221*c* to a reference plane containing central region 225 and oriented perpendicular to central axis 205 in the side view. In embodiments described herein, each angle β is less than 45°, preferably less than 30°, and more preferably ranges from 2° to 25°. In this embodiment, each angle β is the same, and in particular, each angle β is less than 12°. As will be described in more detail below, the pair of relief regions 222 disposed on each lateral side of each cutting region 221 slope axially downward moving circumferentially away from the cutting region 222. Consequently, each cutting region 221 may be described as a raised "ridge" or a cutting "ridge" disposed between a corresponding pair of circumferentially adjacent relief regions 222 and extending from central region 225 to outer surface 212 and chamfer 211.

Although cutting regions 221*a*, 221*b*, 221*c* are planar in this embodiment, in other embodiments, the cutting regions (e.g., cutting regions 221*a*, 221*b*, 221*c*) may be convex or bowed outwardly. In embodiments described herein, each cutting region 221*a*, 221*b*, 221*c* is preferably polished to an average roughness Ra of less than 1000 nanometers, and preferably less than 500 nanometers.

As will be described in more detail below, cutter elements 200 are mounted to cutter supporting surfaces 144 of blades 141, 142 with the radially outer end (relative to axis 205) of one of the cutting regions 221*a*, 221*b*, 221*c* of each cutter element 200 positioned to engage and shear the formation. Accordingly, the edge at the radially outer end of each cutting region 221*a*, 221*b*, 221*c* distal central region 225 (e.g., at the intersection of each cutting region 221*a*, 221*b*, 221*c* and chamfer 211) defines a cutting edge 223 of cutter element 200.

Figure 5E:
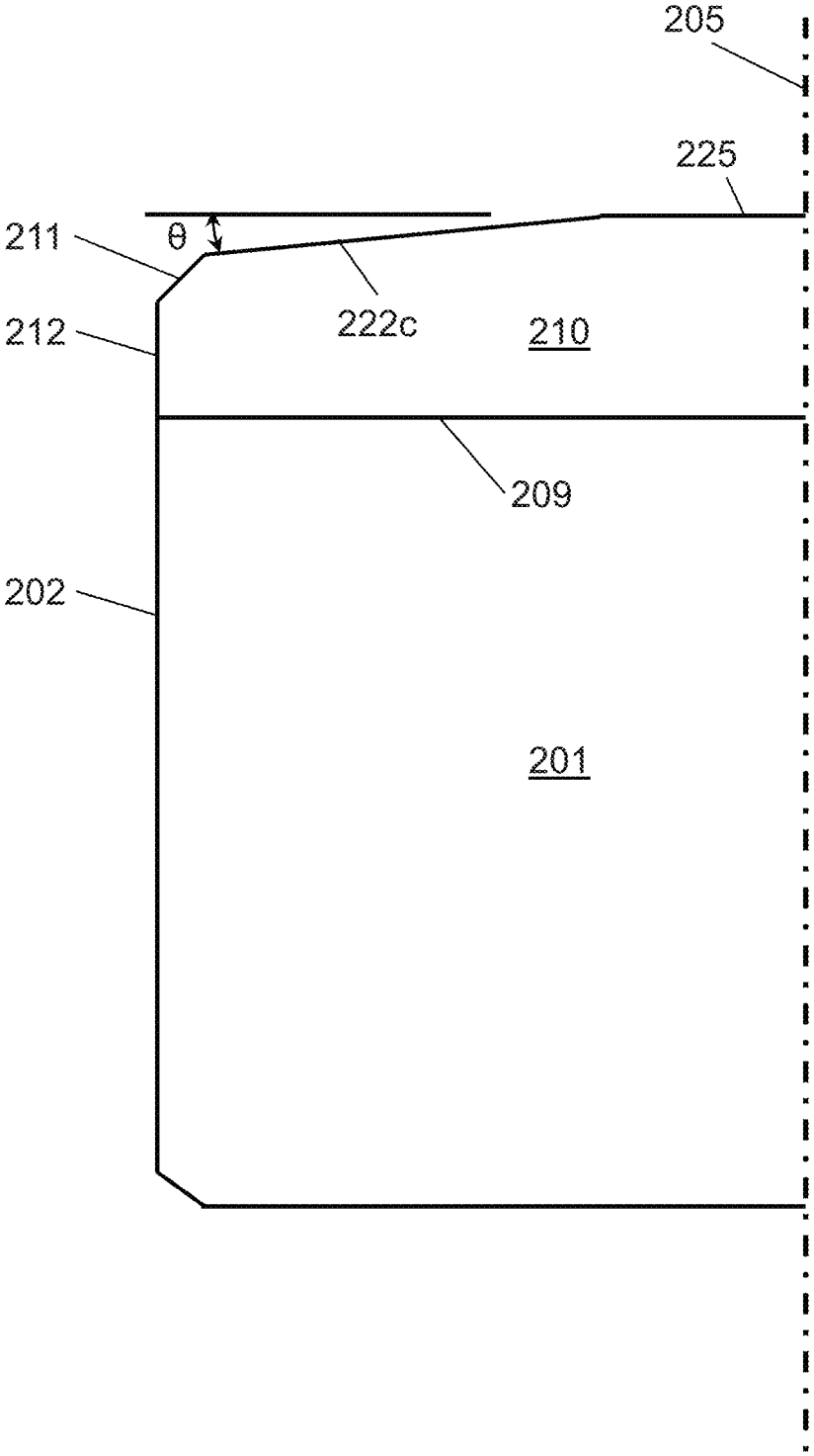
FIG. 5E is a partial cross-sectional view of one the cutter element of FIG. 5A taken in section 5E-5E of FIG. 5B.

Referring again to FIGS. 5A-5D, each relief region 222*a*, 222*b*, 222*c* extends from central region 225 and the pair of circumferentially adjacent cutting regions 221*a*, 221*b*, 221*c* to outer surface 212 and chamfer 211. In this embodiment, each relief region 222*a*, 222*b*, 222*c* is planar, and thus, may also be referred to as a "planar" surface or facet. In addition, in this embodiment, each relief region 222*a*, 222*b*, 222*c* slopes axially downward toward base 201 moving radially outward from central region 225 to outer surface 212 and chamfer 211. In particular, as best shown in FIG. 5E, each relief facet 222*a*, 222*b*, 222*c* is oriented at a non-zero acute angle θ measured upward from the relief facet 222*a*, 222*b*, 222*c* to a reference plane containing central region 225 and oriented perpendicular to central axis 205 in the side view. In embodiments described herein, each angle θ is greater than each angle β, and further, each angle θ is less than 60°, preferably less than 45°, and more preferably ranges from 2° to 40°. Since each angle θ is greater than each angle β, relief regions 222*a*, 222*b*, 222*c* may be described as sloping downward toward substrate 201 moving from central region 225 to outer surface 212 and chamfer 211, as well as moving from the corresponding pair of circumferentially adjacent cutting regions 221*a*, 221*b*, 221*c* to outer surface 212 and chamfer 211. In this embodiment, each angle θ is the same, and in particular, each angle θ is less than 24°.

Although relief regions 222*a*, 222*b*, 222*c* are planar in this embodiment, in other embodiments, the relief regions (e.g., relief regions 222*a*, 222*b*, 222*c*) may be convex or bowed outwardly. In embodiments described herein, each relief region 222*a*, 222*b*, 222*c* is preferably polished to an average roughness Ra of less than 1000 nanometers, and preferably less than 500 nanometers.

Referring to FIGS. 5A-5D, as previously described, cutting regions 221 slope axially downward toward substrate 201 moving from central region 225 to outer surface 212 and chamfer 211, and relief regions 222 slope axially downward toward substrate 201 moving from central region 225 to outer surface 212 and chamfer 211. As a result, central regions 225 defines a peak along cutting face 220. More specifically, as best shown in FIGS. 5C and 5D, cutter element 200 has a height $H_{200}$ measured axially (relative to axis 205) from end 201*b* to cutting face 220 at end 210*a* in side view. The height $H_{200}$ of cutter element is maximum and constant along central region 225, and then decreases moving from along cutting regions 221 and relief regions 222 from central region 225 to outer surface 212 and chamfer 211.

Referring again to FIGS. 2 and 3, cutting elements 200 are mounted in bit body 110 such that cutting faces 220 are exposed to the formation material, and further, such that cutting faces 220 are oriented so that cutting edges 223, cutting regions 221, and relief regions 222 are positioned to perform their distinct functional roles in shearing, excavating, and removing rock from beneath the drill bit 110 during rotary drilling operations. More specifically, each cutter element 200 is mounted to a corresponding blade 141, 142 with substrate 201 received and secured in a pocket formed in the cutter support surface 144 of the blade 141, 142 to which it is fixed by brazing or other suitable means. In addition, each cutter element 200 is oriented with axis 205 oriented generally parallel or tangent to cutting direction 106 and such that the corresponding cutting face 220 is exposed and leads the cutter element 200 relative to cutting direction 106 of bit 100. As previously described, cutting faces 220 are forward-facing. In addition, each cutter element 200 is oriented with one cutting edge 223 distal the corresponding cutter support surface 144 to define an extension height of the corresponding cutter element 200. In general, the extension height of a cutter element (e.g., cutter element 200) is the distance from the cutter support surface of the blade to which the cutter element is mounted to the outermost point or portion of the cutter element as measured perpendicular to the cutter supporting surface. The extension heights of cutter elements 200 can be selected to so as to ensure that cutting edges 223 of cutter elements 200 achieve the desired depth of cut, or at least be in contact with the rock during drilling.

During drilling operations, each cutting face 220 engages, penetrates, and shears the formation as the bit 100 is rotated in the cutting direction 106 and is advanced through the formation. Due to the orientation of cutter elements 200, the cutting edges 223 defining the extension heights of cutter elements 200 function as the primary cutting edges as cutter elements 200 engage the formation. The sheared formation material slides along the corresponding cutting regions 221 and the pairs of circumferentially adjacent relief regions 222 as cutting faces 220 pass through the formation. Thus, as each cutting face 220 advances through the formation, it cuts a kerf in the formation generally defined by the cutting profile of the cutting face 220. The geometry of cutting face 220 is particularly designed to offer the potential to improving cutting efficiency and cleaning efficiency to increase rate of penetration (ROP) and durability of bit 100. In particular, the downward slope of cutting regions 221 toward base 201 moving from central region 225 to outer surface 212 increases relief relative to the corresponding cutting edge 223, which allows drilling fluid to be directed toward the cutting edge 223 and formation cuttings to efficiently slide along cutting face 220. The downward slope of the pair of circumferentially adjacent relief regions 222 toward base 201 moving laterally from the cutting edge 223 allows cutting face 220 to draw the extrudates of formation material.

As previously described, embodiments of cutter elements 200 include a plurality of circumferentially-spaced cutting edges 223. In the embodiment of cutter element 200 shown in FIGS. 5A-5D, three uniformly circumferentially-spaced cutting edges 223 are provided. Thus, each cutter element 200 can be oriented such that one of the cutting edges 223 of each cutter element 200 is used first to engage, penetrate, and shear the formation, and then when those cutting edges 223 are sufficiently worn (e.g., the cutting efficiency and rate of penetration of the bit are sufficiently low), cutter elements 200 can be removed from the bit body 110, and then re-mounted to bit body 110 with another one of the cutting edges 223 of each cutter element 200 positioned to engage, penetrate and shear the formation. Since this embodiment of cutter element 200 includes three cutting edges 223, cutter elements 200 can be removed, remounted, and reused twice. The ability to reuse cutter elements 200 after one cutting edge 223 is sufficiently worn offers the potential to significantly increase the operating lifetime of cutter elements 200 as compared to other cutter elements that include only one primary cutting edge.

In the embodiment of cutter element 200 previously described and shown in FIGS. 5A-5D, cutting ridges 221 are relatively wide (e.g., the ratio of the width $W_{221}$ of each cutting ridge 221*a*, 221*b*, 221*c* to the diameter of cutter element 200 is larger than 0.10, and boundaries 226*a*, 226*b*, 226*c*, 226*d*, 226*e*, 226*f* between regions 221, 222 and central region 225 are linear. However, in other embodiments, the cutting ridges (e.g., cutting ridges 221) may be wider, the boundaries between the cutting ridges and the central region (e.g., boundaries 226*a*, 226*c*, 226*e*) may be curved, the boundaries between the relief regions (e.g, relief regions 222) and the central regions (e.g., boundaries 226*b*, 226*d*, 226*f*) may be curved, or combinations thereof.

Referring now to FIGS. 6A-6D, another embodiment of a cutter element 300 is shown. In general, a plurality of cutter elements 300 can be used in place of cutter elements 200 on bit 100 previously described. Cutter element 300 is substantially the same as cutter element 200 previously described with the exception that the cutting regions (e.g., cutting regions 221) have a reduced width and the boundaries between the central region and the cutting regions (e.g., boundaries 226*a*, 226*c*, 226*e*) are curved (as opposed to linear). More specifically, in this embodiment, insert 300 includes a base 201 and a cutting disc or layer 210 bonded to the base 201 at a plane of intersection 209. Base 201 and cutting layer 210 are each as previously described. Thus, base 201 has a central axis 205, a first end 201*a* bonded to cutting layer 210, a second end 201*b* distal cutting layer 210, and a radially outer surface 202 extending axially between ends 201*a*, 201*b*. In addition, cutting layer 210 has a first end 210*a* distal substrate 201, a second end 210*b* bonded to end 201*a* of substrate 201, and a radially outer surface 212 extending axially between ends 210*a*, 210*b*. The outer surface of cutting layer 210 at first end 210*a* defines the cutting face 320 of cutter element 300. In this embodiment, a chamfer or bevel 211 is provided at the intersection of cutting face 320 and outer surface 212 about the entire outer periphery of cutting face 320.

Cutting face 320 is substantially the same as cutting face 220 previously described. In particular, cutting face 320 includes a central region or surface 225, a plurality of uniformly circumferentially-spaced cutting regions or surfaces 221 extending radially from central region 225 to outer surface 212 and chamfer 211, and a plurality of relief regions or surfaces 222 extending from central region 225 and cutting regions 221 to outer surface 212 and chamfer 211. Regions 221, 222 are circumferentially disposed about axis 205 and central region 225, and are arranged in an circumferentially alternating manner such that regions 221, 222 are positioned circumferentially adjacent each other with each region 221 circumferentially disposed between a pair of circumferentially-adjacent regions 222, and each region 222 circumferentially disposed between a pair of circumferentially-adjacent regions 221. In this embodiment, cutting face 320 includes three cutting regions 221 angularly spaced 120° apart about axis 205 and three relief regions 222 angularly spaced 120° apart about axis 205. For purposes of clarity and further explanation, cutting regions 221 may also be labeled 221*a*, 221*b*, 221*c* and relief regions 222 may also be labeled 222*a*, 222*b*, 322*c*.

Figure 6A:
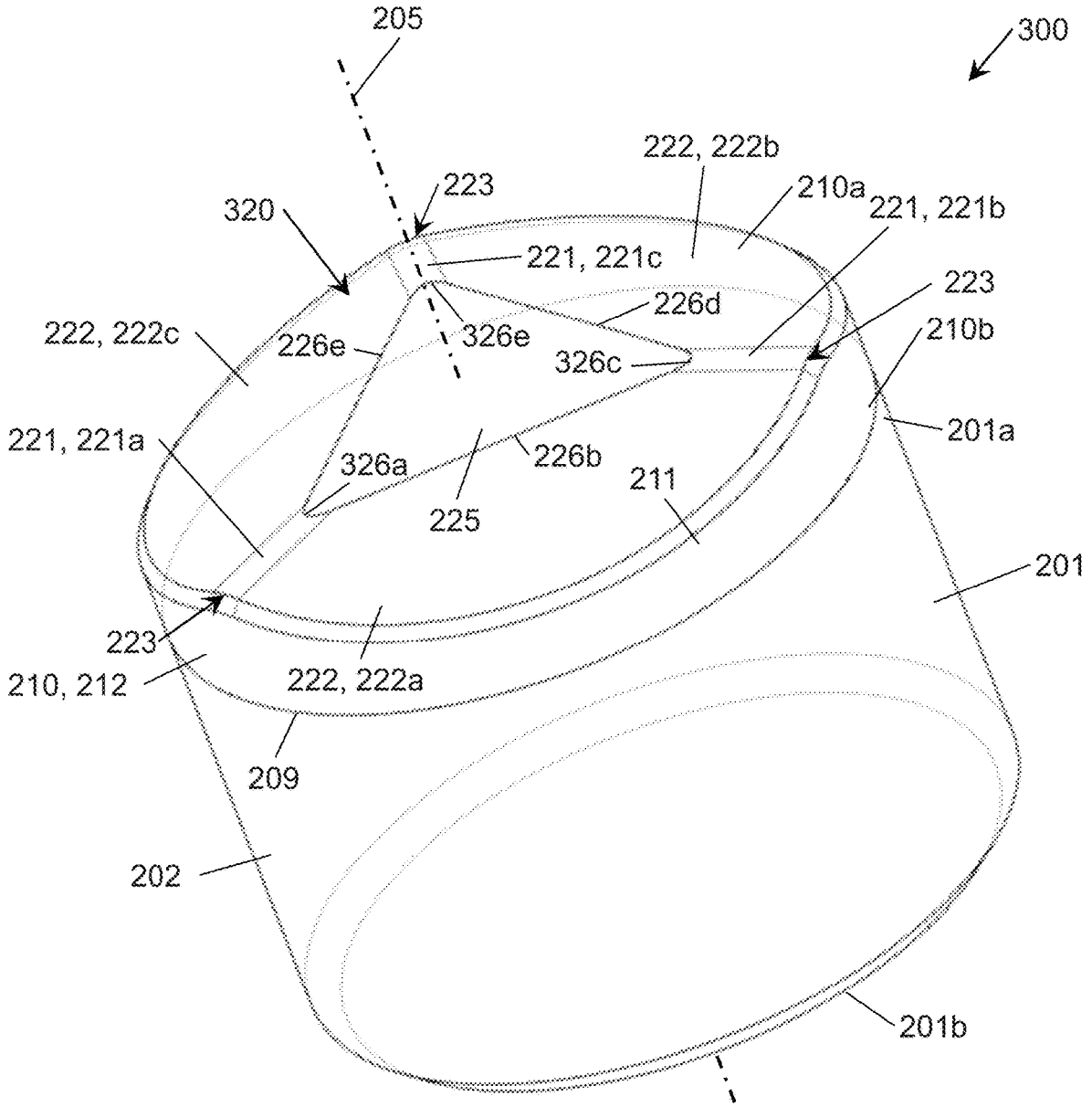
FIGS. 6A-6D are perspective, top, rear side, and lateral side views, respectively, of an embodiment of a cutter element in accordance with the principles described herein.
Figure 6B:
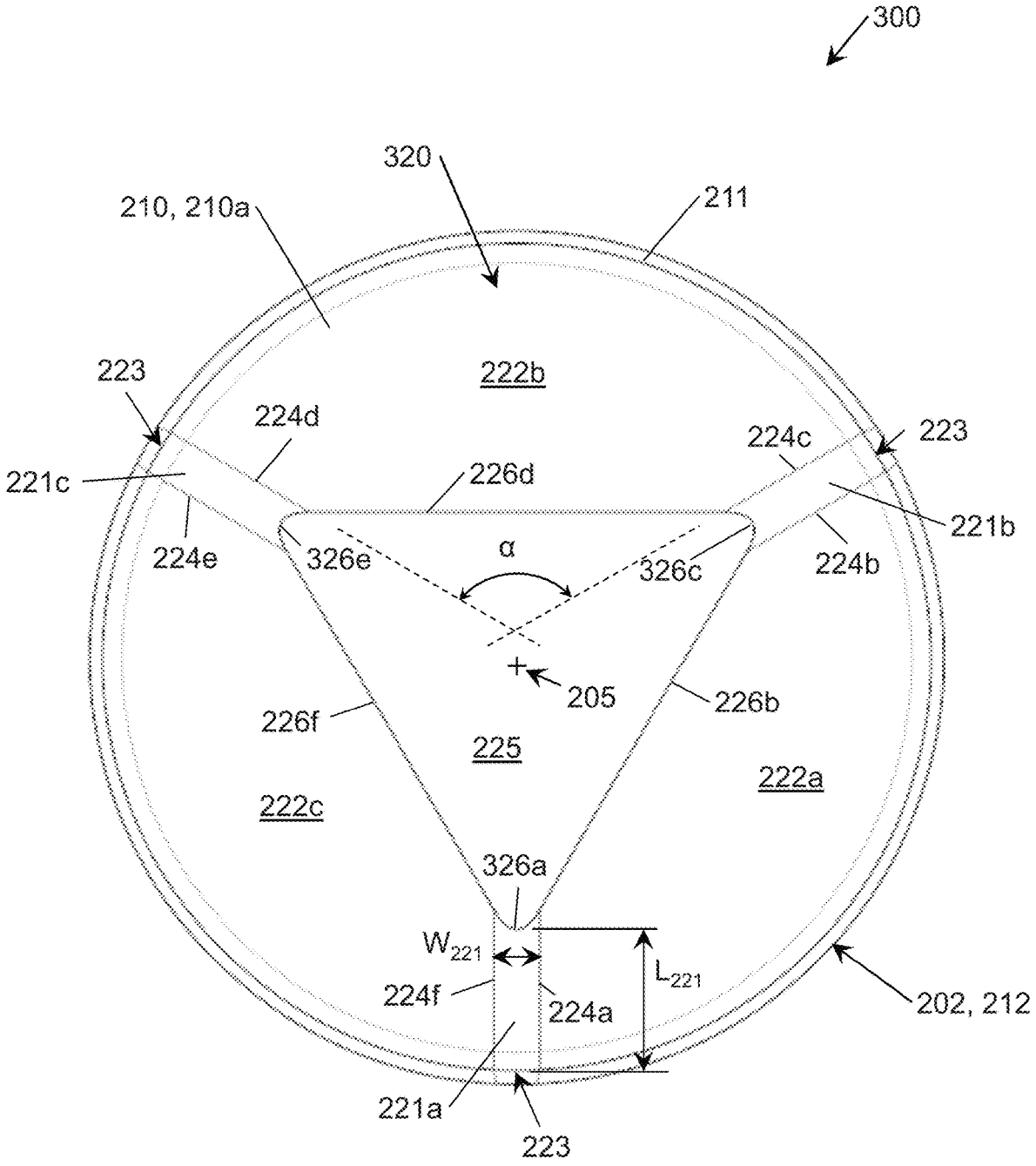

As best shown in FIG. 6B, linear boundaries or edges are provided at the intersection of each circumferentially adjacent region 221, 322, and a linear boundary or edge is provided at the intersection of central region 225 and each region 222. In particular, regions 221*a*, 222*a* intersect at a linear edge 224*a*, regions 222*a*, 221*b* intersect at a linear edge 224*b*, regions 221*b*, 222*b* intersect at a linear edge 224*c*, regions 222*b*, 221*c* intersect at a linear edge 224*d*, regions 221*c*, 222*c* intersect at a linear edge 224*e*, and regions 222*c*, 221*a* intersect at a linear edge 224*f*. Edges 224*a*, 224*b*, 224*c*, 224*d*, 224*e*, 224*f* are as previously described. However, unlike cutter element 200 previously described, in this embodiment, the boundary or edge between central region 225 and each cutting region 221 is not linear. Rather, in this embodiment, regions 225, 221*a* intersect at a curved edge 326*a*, regions 225, 221*b* intersect at a curved edge 326*c*, and regions 225, 221*c* intersect at a curved edge 326*e*. Curved edges 326*a*, 326*c*, 326*e* are convex or bowed outwardly relative to central axis 205. Edges 326*a*, 226*b*, 326*c*, 226*d*, 326*e*, 226*f* are connected end-to-end to form the closed polygon with rounded corners that defines central region 225.

The pair of linear edges 224*a*, 224*b*, 224*c*, 224*d*, 224*e*, 224*f* defining the circumferential ends of each relief region 222*a*, 222*b*, 222*c* are oriented at an angle α relative to each other in top view. The angle α between linear edges 224*a*, 224*b*, the angle α between linear edges 224*c*, 224*d*, and the angle α between linear edges 224*e*, 224*f* are each preferably between 45° and 75°, and more preferably between 55° and 65°. In this embodiment, each angle α is 60°.

Cutting regions 221 are as previously described with the exception of the width of cutting regions 221. In particular, as best shown in FIG. 6B, linear edges 224*a*, 224*f* are parallel, linear edges 224*b*, 224*c* are parallel, and linear edges 224*d*, 224*e* are parallel. In addition, each cutting region 221*a*, 221*b*, 221*c* has a width $W_{221}$ measured perpendicularly from one edge 224*f*, 224*b*, 224*d* of the region 221*a*, 221*b*, 221*c*, respectively, to the other edge 224*f*, 224*c*, 224*e* of the region 221*a*, 221*b*, 221*c*, respectively, in top view; and each cutting region 221*a*, 221*b*, 221*c* has a length $L_{221}$ measured radially from the central region 225 and the corresponding edge 226*a*, 226*c*, 226*e* to outer surface 212 and chamfer 211. Due to the orientation of edges 224*a*, 224*b*, 224*c*, 224*d*, 224*e*, 224*f*, the width $W_{221}$ of each cutting region 221*a*, 221*b*, 221*c* is uniform or constant moving radially along the region 221*a*, 221*b*, 221*c*, respectively, from central region 225 to outer surface 212 and chamfer 211. As previously described, the width $W_{221}$ of each cutting region 221*a*, 221*b*, 221*c* is preferably ranges from 1.0 mm to 5.0 mm, and more preferably ranges from 1.0 mm to 2.0 mm; and the ratio of the width $W_{221}$ of each cutting region 221*a*, 221*b*, 221*c* to the diameter of cutter element 200 preferably ranges from 0.05 to 0.50, and more preferably ranges from 0.10 to 0.17. In addition, the ratio of the length $L_{221}$ of each cutting region 221*a*, 221*b*, 221*c* to the diameter of the cutting element 200 preferably ranges from 0.0 to 0.5, and more preferably ranges from 0.125 to 0.325. In cutter element 200 previously described, the ratio of the width $W_{221}$ of each cutting region 221*a*, 221*b*, 221*c* to the diameter of cutter element 200 is greater than 0.10, and the ratio of the length $L_{221}$ of each cutting region 221*a*, 221*b*, 221*c* to the diameter of the cutting element 300 is about 0.25. In comparison, in this embodiment of cutter element 300, the ratio of the width $W_{221}$ of each cutting region 221*a*, 221*b*, 221*c* to the diameter of cutter element 300 is less than 0.10, and the ratio of the length $L_{221}$ of each cutting region 221*a*, 221*b*, 221*c* to the diameter of the cutting element 300 is less than 0.25.

Figure 6C:
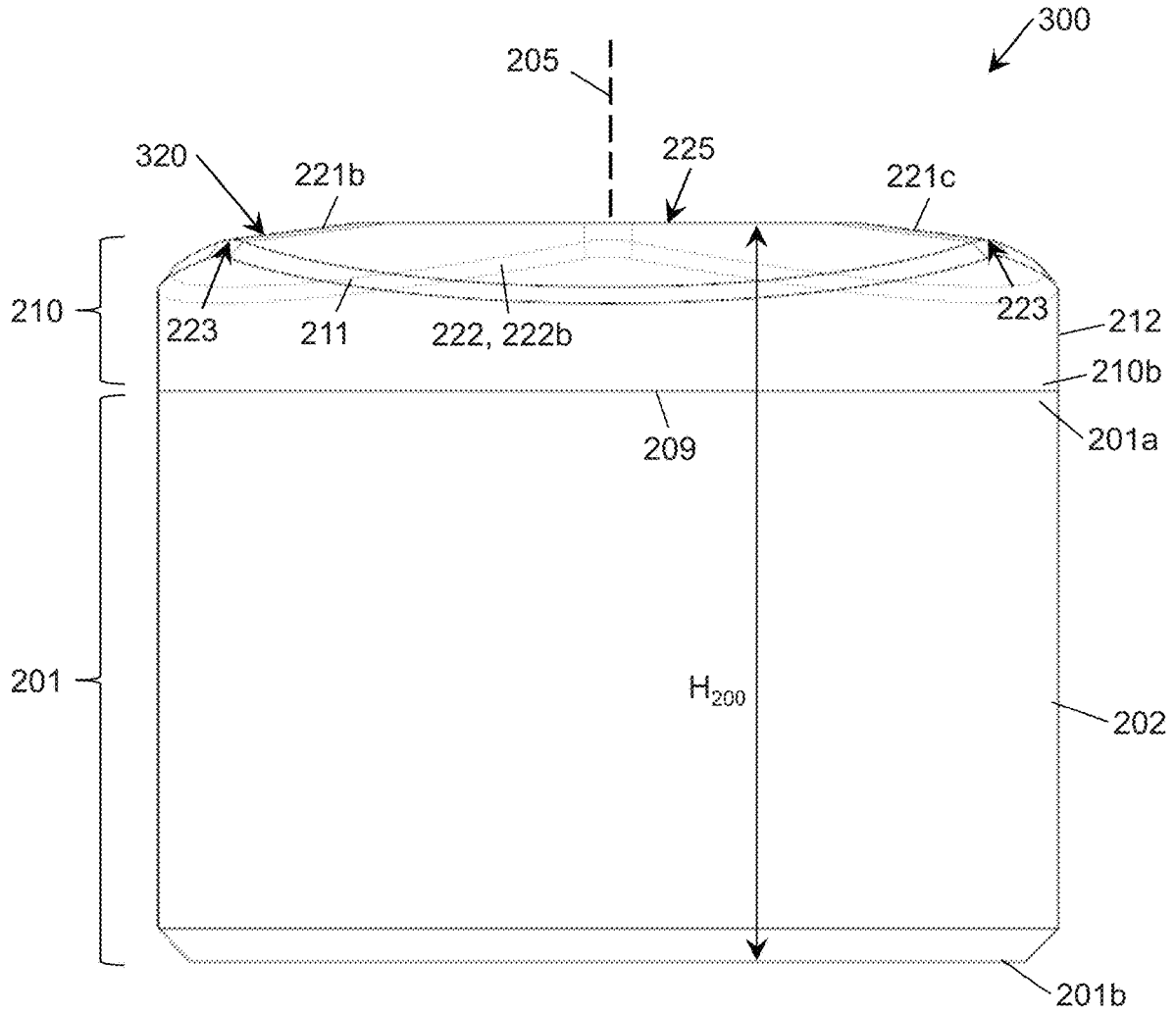
Figure 6D:
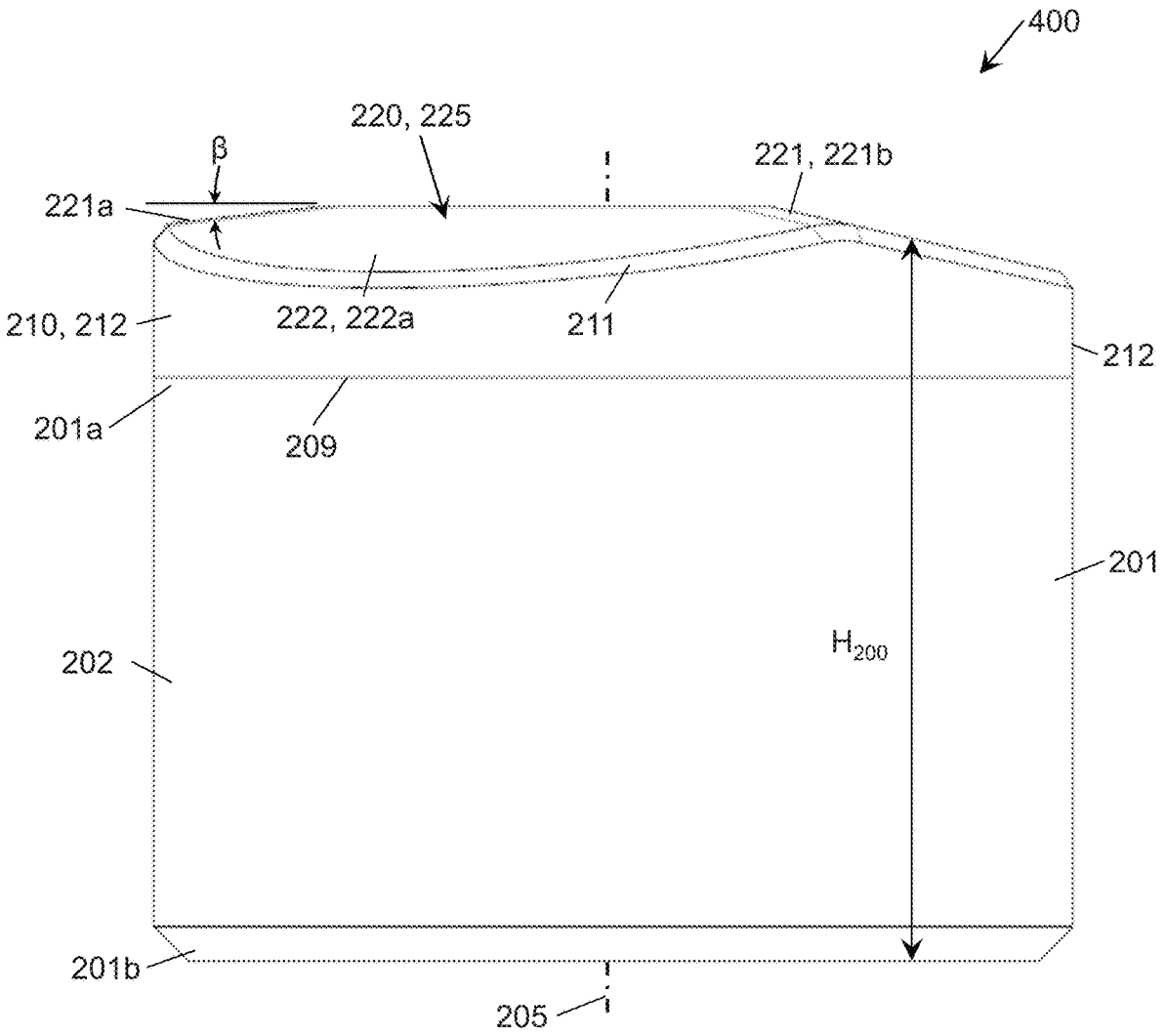
Figure 7A:
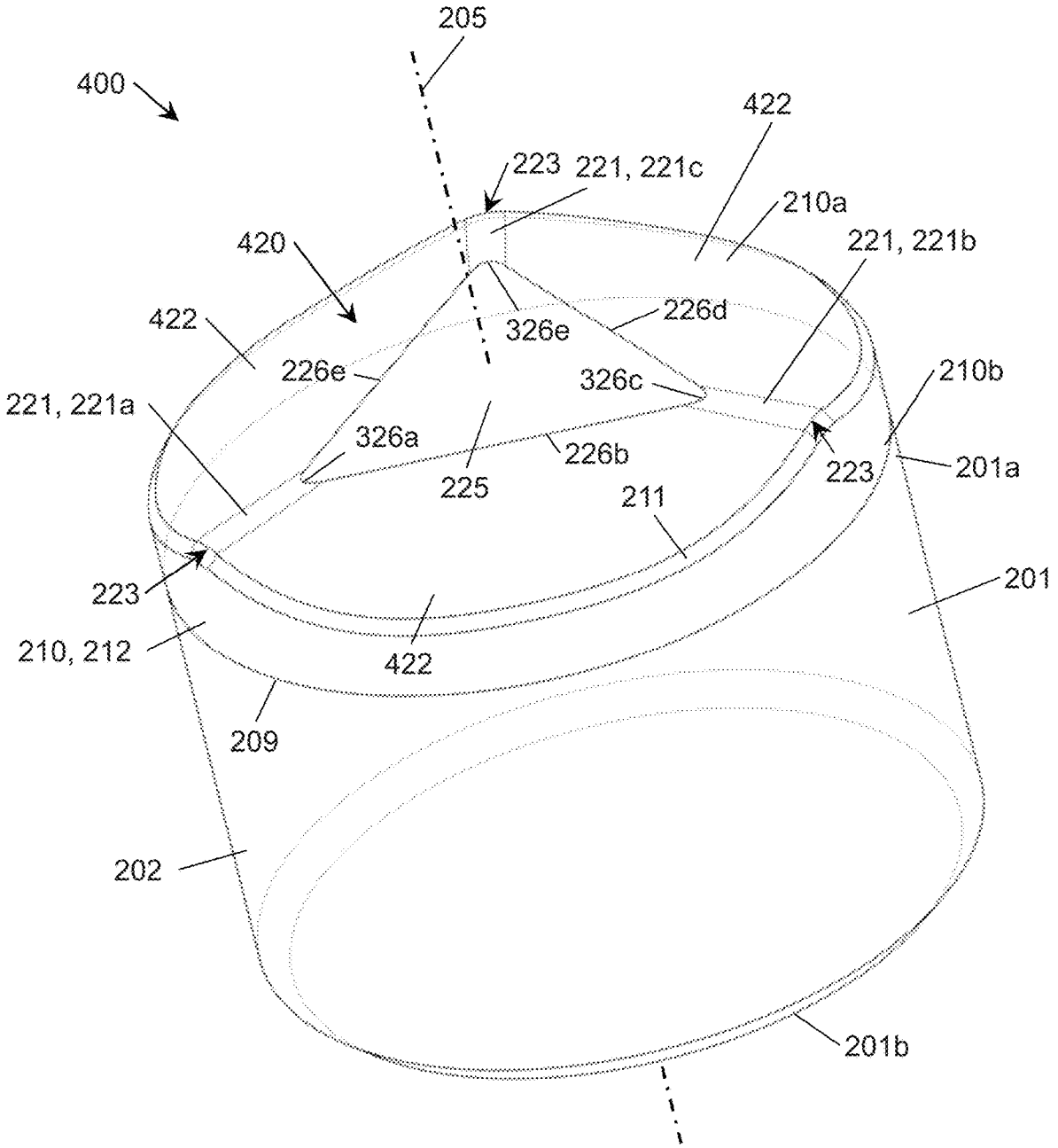
FIGS. 7A-7D are perspective, top, rear side, and lateral side views, respectively, of an embodiment of a cutter element in accordance with the principles described herein.
Figure 7B:
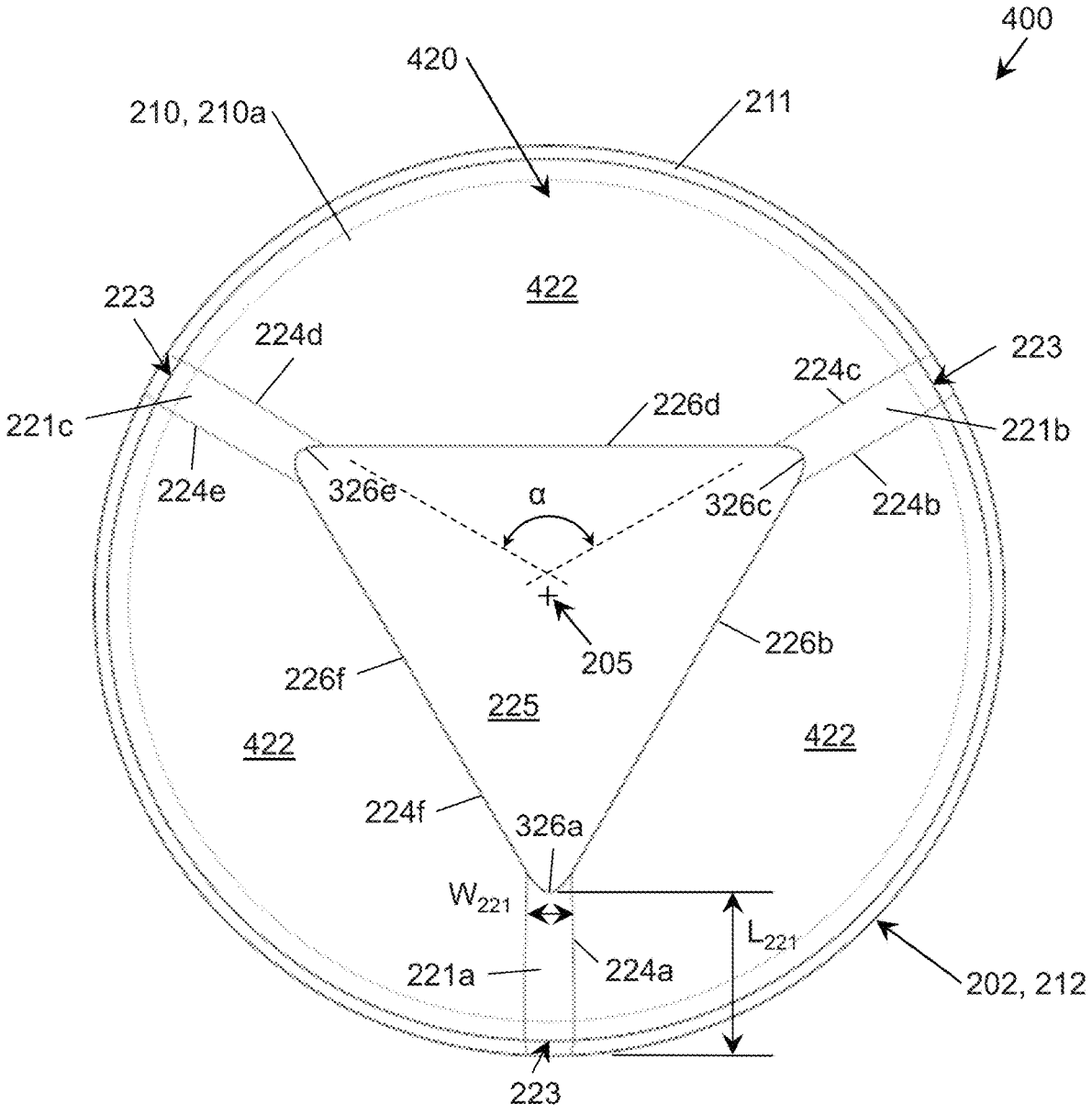
Figure 7C:
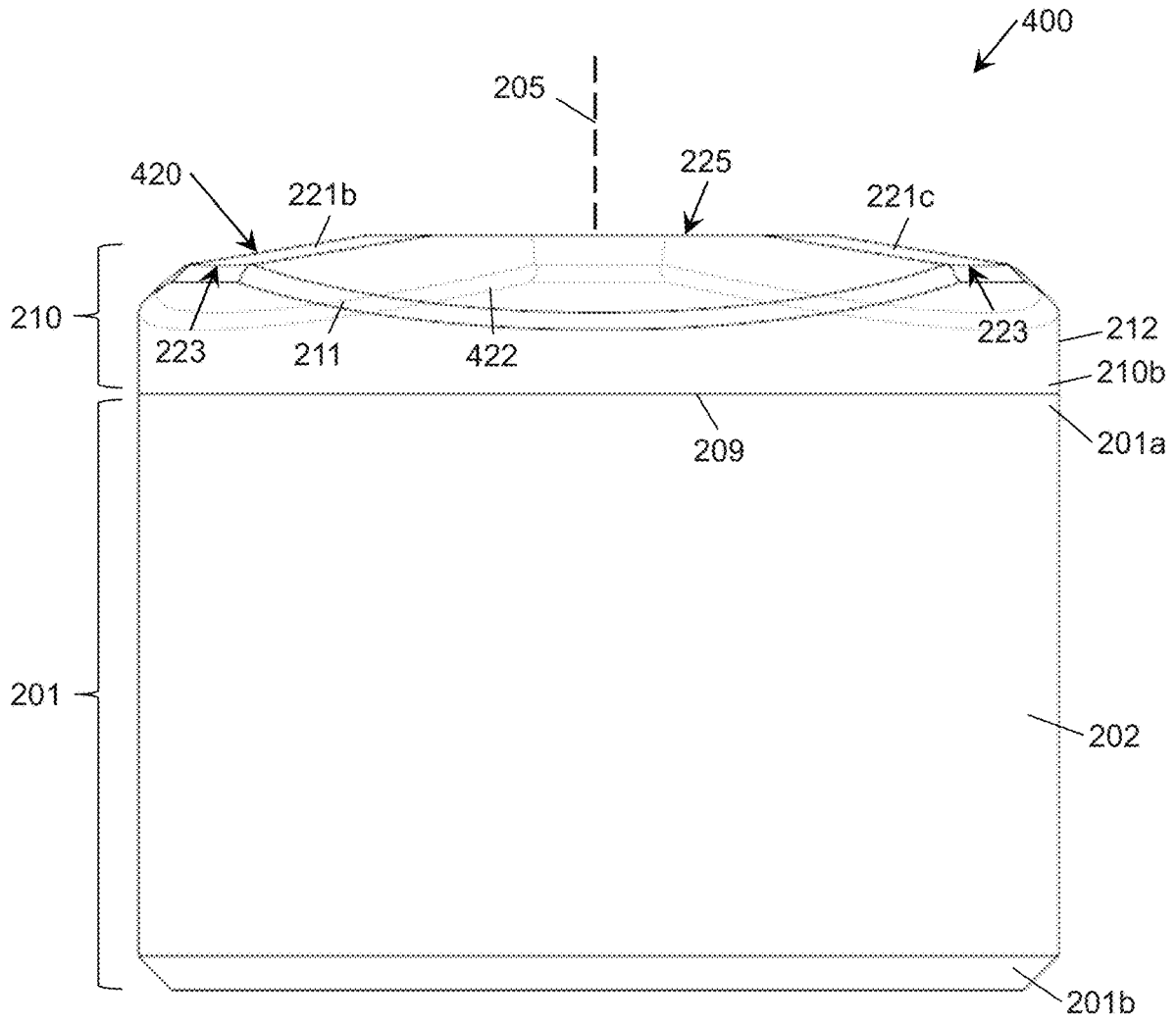
Figure 7D:
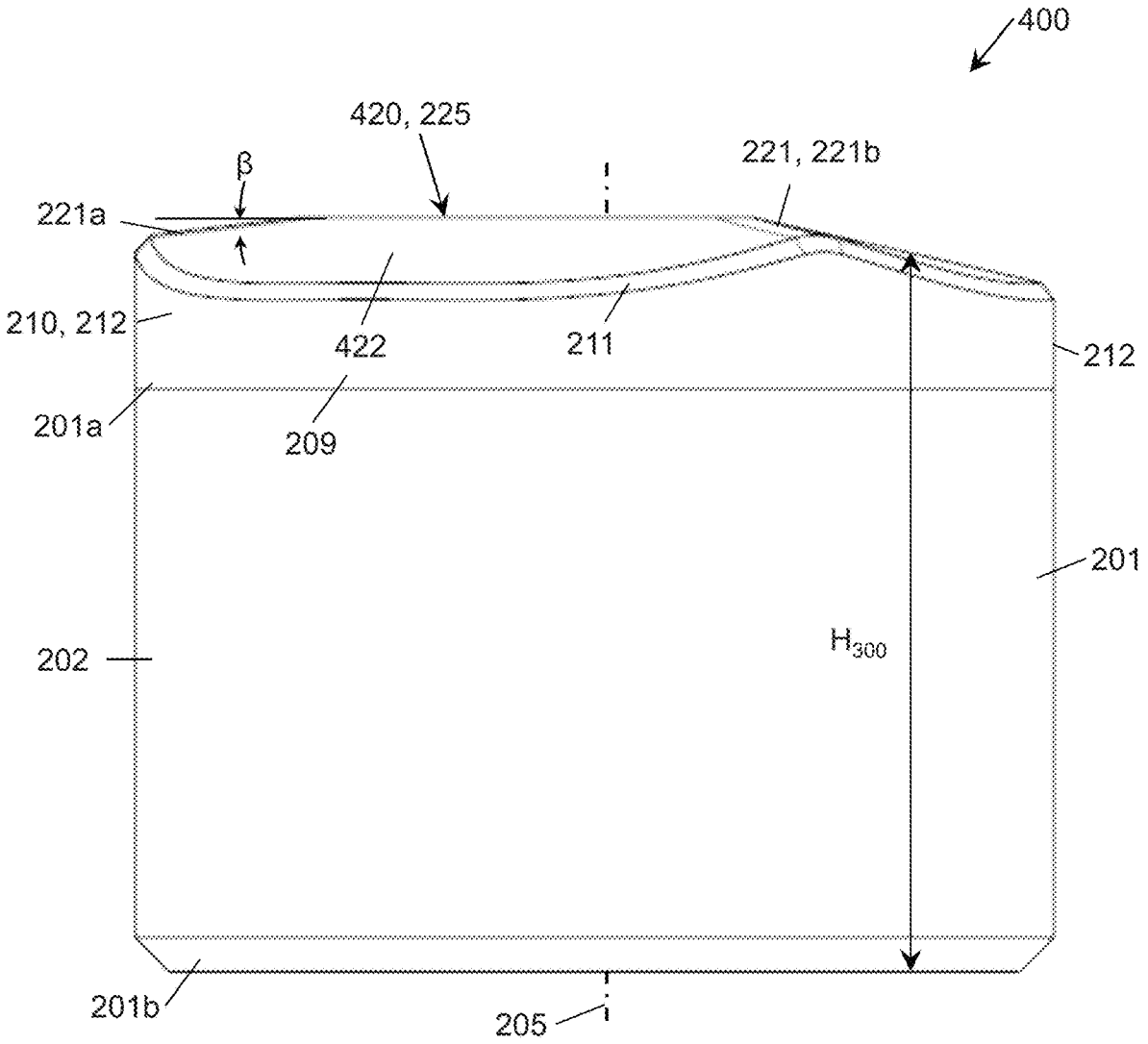

Moreover, each cutting region 221*a*, 221*b*, 221*c* is planar and slopes axially downward toward base 201 moving radially outward from central region 225 to outer surface 212 and chamfer 211. In particular, as best shown in FIG. 6D, each cutting facet 221*a*, 221*b*, 221*c* is oriented at a non-zero acute angle β measured upward from the cutting facet 221*a*, 221*b*, 221*c* to a reference plane containing central region 225 and oriented perpendicular to central axis 205 in the side view. As previously described, in embodiments described herein, each angle β is less than 45°, preferably less than 30°, and more preferably ranges from 2° to 25°. In this embodiment, each angle β is the same, and in particular, each angle β is less than 12°. As previously described, each cutting region 221*a*, 221*b*, 221*c* is preferably polished to an average roughness Ra of less than 1000 nanometers, and more preferably less than 500 nanometers. The edge at the radially outer end of each cutting region 221*a*, 221*b*, 221*c* distal central region 225 (e.g., at the intersection of each cutting region 221*a*, 221*b*, 221*c* and chamfer 211) defines a cutting edge 223 of cutter element 300.

Referring still to FIG. 6B, central region 225 is also as previously described. In particular, central region 225 is radially centered on cutting face 320 and centered relative to axis 205. In addition, central surface or region 225 is planar and oriented perpendicular to axis 205. As previously described, central region 225 is preferably polished to an average roughness Ra of less than 1000 nanometers, and more preferably less than 500 nanometers.

Cutting regions 221 and relief regions 222 generally slope axially downward toward substrate 201 moving from central region 225 to outer surface 212 and chamfer 211. As a result, central region 225 defines a peak along cutting face 320. Thus, as shown in FIGS. 6C and 6D, the height $H_{300}$ of cutter element 300 measured axially (relative to axis 205) from end 201*b* to cutting face 320 and end 201*a* is a maximum along central region 225 and then decreases moving radially outward along regions 221, 322 from central region 225 to outer surface 212 and chamfer 211.

Referring again to FIGS. 6A-6D, each relief region 222*a*, 222*b*, 222*c* is planar. In addition, each relief region 222*a*, 222*b*, 222*c* slopes axially downward toward base 201 moving radially outward from central region 225 to outer surface 212 and chamfer 211. In particular, each relief region 222*a*, 222*b*, 222*c* is oriented at a non-zero acute angle θ measured upward from the relief facet 222*a*, 222*b*, 222*c* to a reference plane containing central region 225 and oriented perpendicular to central axis 205 in the side view. As previously described, in embodiments described herein, each angle θ is greater than each angle β, and further, each angle θ is less than 60°, preferably less than 45°, and more preferably ranges from 2° to 40°. Since each angle θ is greater than each angle β, relief regions 222*a*, 222*b*, 222*c* may be described as sloping downward toward substrate 201 moving from central region 225 to outer surface 212 and chamfer 211, as well as moving from the corresponding pair of circumferentially adjacent cutting regions 221*a*, 221*b*, 221*c* to outer surface 212 and chamfer 211. In this embodiment, each angle θ is the same, and in particular, each angle θ is less than 12°.

Cutting elements 300 are mounted in bit body 110 in the same manner and orientation as cutter elements 200 previously described. More specifically, each cutter element 300 is mounted to a corresponding blade 141, 142 with substrate 201 received and secured in a pocket formed in the cutter support surface 144 of the blade 141, 142 to which it is fixed by brazing or other suitable means. In addition, each cutter element 300 is oriented with axis 205 oriented generally parallel or tangent to cutting direction 106 and such that the corresponding cutting face 320 is exposed and leads the cutter element 300 relative to cutting direction 106 of bit 100. Further, cutter elements 300 are oriented one cutting edge 223 distal the corresponding cutter supporting surface 144 and defining the extension height of the cutter element 300.

During drilling operations, cutting faces 320 of cutter elements 300 engage, penetrate, and shear the formation in the same manner as cutting faces 220 of cutter elements 200 previously described. In the same manner as previously described with respect to cutter element 200, since cutting faces 320 of cutter elements 300 include a plurality of cutting edges 223 (e.g., three cutting edges 223), one cutting edge 223 of each cutter element 300 can be used first to engage, penetrate, and shear the formation, and then when those cutting edges 223 are sufficiently worn (e.g., the cutting efficiency and rate of penetration of the bit are sufficiently low), cutter elements 300 can be removed from the bit body 110, and then re-mounted to bit body 110 with one of the other cutting edges 223 positioned to engage, penetrate and shear the formation. The ability to reuse cutter elements 300 after one cutting edge 223 is sufficiently worn offers the potential to significantly increase the operating lifetime of cutter elements 300 as compared to other cutter elements that include only one primary cutting edge.

In the embodiments of cutter elements 200, 300 previously described and shown in FIGS. 5A-5D and 6A-6D cutting regions 221 and relief regions 222 are planar. However, in other embodiments, the cutting regions (e.g., cutting regions 221) may be curved (e.g., concave or convex) and/or the relief regions (e.g., relief regions 222) may be curved (e.g., concave or convex).

Referring now to FIGS. 7A-7D, another embodiment of a cutter element 400 is shown. In general, a plurality of cutter elements 400 can be used in place of cutter elements 200 on bit 100 previously described. Cutter element 400 is substantially the same as cutter element 300 previously described with the exception that the relief regions (e.g., relief regions 222) are concave (as opposed to planar). More specifically, in this embodiment, insert 400 includes a base 201 and a cutting disc or layer 210 bonded to the base 201 at a plane of intersection 209. Base 201 and cutting layer 210 are each as previously described. Thus, base 201 has a central axis 205, a first end 201*a* bonded to cutting layer 210, a second end 201*b* distal cutting layer 210, and a radially outer surface 202 extending axially between ends 201*a*, 201*b*. In addition, cutting layer 210 has a first end 210*a* distal substrate 201, a second end 210*b* bonded to end 201*a* of substrate 201, and a radially outer surface 212 extending axially between ends 210*a*, 210*b*. The outer surface of cutting layer 210 at first end 210*a* defines the cutting face 420 of cutter element 400. In this embodiment, a chamfer or bevel 211 is provided at the intersection of cutting face 320 and outer surface 212 about the entire outer periphery of cutting face 420.

Cutting face 420 is substantially the same as cutting face 320 previously described. In particular, cutting face 320 includes a central region or surface 225 and a plurality of uniformly circumferentially-spaced cutting regions or surfaces 221 extending radially from central region 225 to outer surface 212 and chamfer 211. Central region 225 and cutting regions 221 are each as previously described with respect to cutter element 300. This embodiment also includes a plurality of relief regions or surfaces 422 extending from central region 225 and cutting regions 221 to outer surface 212 and chamfer 211. Regions 221, 422 are circumferentially disposed about axis 205 and central region 225. In addition, regions 221, 422 are arranged in an circumferentially alternating manner such that regions 221, 422 are positioned circumferentially adjacent each other with each region 221 circumferentially disposed between a pair of circumferentially-adjacent regions 422, and each region 422 circumferentially disposed between a pair of circumferentially-adjacent regions 221. However, unlike planar relief regions 222 previously described, in this embodiment, relief regions 422 are smoothly curved and continuously contoured. More specifically, each relief region 422 is concave or bowed inwardly between corresponding linear edges 224*a*, 224*b*, 224*c*, 224*d*, 224*e*, 224*f* and between the corresponding circumferentially adjacent cutting edges 223. In addition, each relief region 422 generally slopes axially downward toward base 210 moving circumferentially from each pair of circumferentially adjacent edges 224*a*, 224*b*, 224*c*, 224*d*, 224*e*, 224*f* toward the circumferential center of the relief region 422. More specifically, in side view, the slope of each region 422 generally decreases moving circumferentially from each pair of circumferentially adjacent edges 224*a*, 224*b*, 224*c*, 224*d*, 224*e*, 224*f* toward the circumferential center of the relief region 422.

Cutting elements 400 are mounted in bit body 110 in the same manner and orientation as cutter elements 200 previously described. More specifically, each cutter element 400 is mounted to a corresponding blade 141, 142 with substrate 201 received and secured in a pocket formed in the cutter support surface 144 of the blade 141, 142 to which it is fixed by brazing or other suitable means. In addition, each cutter element 400 is oriented with axis 205 oriented generally parallel or tangent to cutting direction 106 and such that the corresponding cutting face 420 is exposed and leads the cutter element 400 relative to cutting direction 106 of bit 100. Further, cutter elements 400 are oriented one cutting edge 223 distal the corresponding cutter supporting surface 144 and defining the extension height of the cutter element 400.

During drilling operations, cutting faces 420 of cutter elements 400 engage, penetrate, and shear the formation in the same manner as cutting faces 220 of cutter elements 200 previously described. In the same manner as previously described with respect to cutter element 200, since cutting faces 420 of cutter elements 400 include a plurality of cutting edges 223 (e.g., three cutting edges 223), one cutting edge 223 of each cutter element 400 can be used first to engage, penetrate, and shear the formation, and then when those cutting edges 223 are sufficiently worn (e.g., the cutting efficiency and rate of penetration of the bit are sufficiently low), cutter elements 400 can be removed from the bit body 110, and then re-mounted to bit body 110 with one of the other cutting edges 223 positioned to engage, penetrate and shear the formation. The ability to reuse cutter elements 400 after one cutting edge 223 is sufficiently worn offers the potential to significantly increase the operating lifetime of cutter elements 400 as compared to other cutter elements that include only one primary cutting edge.

In embodiments described herein, central region 225, cutting regions 221*a*, 221*b*, 221*c*, and relief regions 222*a*, 222*b*, 222*c* are described as preferably being polished to an average roughness Ra of less than 1000 nanometers, and preferably less than 500 nanometers. However, it should be appreciated that on a given cutting face (e.g., cutting face 220, 320, 420), any two or more of regions 225, 221*a*, 221*b*, 221*c*, 222*a*, 222*b*, 222*c*, may have different average roughnesses Ra and/or any one or more of regions 225, 221*a*, 221*b*, 221*c*, 222*a*, 222*b*, 222*c* may not be polished to a particular average roughness Ra.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A cutter element for a drill bit configured to drill a borehole in a subterranean formation, the cutter element comprising:

a base portion having a central axis, a first end, a second end, and a radially outer surface extending axially from the first end to the second end;

a cutting layer fixably mounted to the first end of the base portion, wherein the cutting layer includes a cutting face distal the base portion and a radially outer surface extending axially from the cutting face to the radially outer surface of the base portion;

wherein the cutting face comprises:

a planar central region centered relative to the central axis and disposed in a plane oriented perpendicular to the central axis;

a plurality of circumferentially-spaced cutting regions disposed about the planar central region, wherein each cutting region extends from the planar central region to the radially outer surface of the cutting layer, and wherein each cutting region slopes axially toward the base portion moving radially outward from the planar central region to the radially outer surface of the cutting layer;

a plurality of circumferentially-spaced relief regions disposed about the planar central region, wherein each relief region extends from the planar central region to the radially outer surface, and wherein each relief region slopes axially toward the base portion moving radially outward from the planar central region to the radially outer surface of the cutting layer;

wherein the plurality of cutting regions and the plurality of relief regions are circumferentially arranged in an alternating manner such that one relief region is circumferentially disposed two circumferentially adjacent cutting regions of the plurality of cutting regions;

wherein each cutting region is defined by a first edge at an intersection of the cutting region and one circumferentially adjacent relief region and a second edge at an intersection of the cutting region and another circumferentially adjacent relief region, wherein each cutting region has a width measured perpendicularly from the first edge to the second edge, and wherein the width of at least one cutting region is constant moving along the at least one cutting region from the planar central region to the radially outer surface of the cutting layer;

wherein each relief region comprises a planar surface extending from the planar central region and a pair of circumferentially adjacent cutting regions to the radially outer surface of the cutting layer.

2. The cutter element of claim 1, wherein each relief region slopes axially downward moving from each circumferentially adjacent cutting region.

3. The cutter element of claim 2, wherein an end of each cutting region radially distal the planar central region comprises a cutting edge configured to engage and shear the subterranean formation.

4. The cutter element of claim 1, wherein each cutting region defines a ridge extending radially from the planar central region and disposed between two of the circumferentially adjacent relief regions.

5. The cutter element of claim 1, wherein each cutting region comprises a planar surface extending from the planar central region to the radially outer surface of the cutting layer, and wherein the planar surface of each cutting region is disposed at an acute angle $\beta$ measured upward from the planar surface to the plane containing the planar central region and oriented perpendicular to the central axis.

6. The cutter element of claim 5, wherein the acute angle $\beta$ ranges from 2° to 25°.

7. The cutter element of claim 6, wherein each acute angle $\beta$ is the same.

8. The cutter element of claim 1, wherein the cutting layer comprises a chamfer at an intersection of the cutting face and the radially outer surface of the cutting layer, wherein the chamfer extends circumferentially about the outer periphery of the cutting face.

9. The cutter element of claim 1, wherein the planar surface of each relief region is disposed at an acute angle $\theta$ measured upward from the planar surface to the plane containing the planar central region, wherein the acute angle $\theta$ is greater than each acute angle $\beta$.

10. The cutter element of claim 1, wherein each relief region intersects the planar central region along a linear edge.

11. The cutter element of claim 10, wherein each cutting region intersects the planar central region along a linear edge.

12. A cutter element for a drill bit configured to drill a borehole in a subterranean formation, the cutter element comprising:

a base portion having a central axis, a first end, a second end, and a radially outer surface extending axially from the first end to the second end;

a cutting layer fixably mounted to the first end of the base portion, wherein the cutting layer includes a cutting face distal the base portion and a radially outer surface extending axially from the cutting face to the radially outer surface of the base portion;

wherein the cutting face comprises:

a planar central region disposed in a plane oriented perpendicular to the central axis;

a plurality of circumferentially-spaced cutting ridges disposed about the planar central region, wherein each cutting ridge comprises a planar surface extending radially outward from the planar central region, wherein the planar surface of each cutting ridge is disposed at an acute angle β measured upward from the planar surface to the plane containing the planar central region, and wherein an end of each cutting ridge radially distal the planar central region comprises a cutting edge configured to engage and shear the subterranean formation;

a plurality of circumferentially-spaced relief regions disposed about the planar central region, wherein each relief region extends from the planar central region, and wherein each relief region slopes axially toward the base portion moving radially outward from the planar central region;

wherein one cutting ridge is circumferentially disposed between a pair of the circumferentially adjacent relief regions;

wherein each cutting ridge is defined by a first edge at an intersection of the cutting ridge and one circumferentially adjacent relief region and a second edge at an intersection of the cutting ridge and another circumferentially adjacent relief region, wherein each cutting ridge has a width measured perpendicularly from the first edge to the second edge, and wherein the width of at least one cutting ridge is constant moving radially along the at least one cutting ridge from the planar central region;

wherein each relief region comprises a planar surface extending from the planar central region and a pair of circumferentially adjacent cutting regions.

13. The cutter element of claim 12, wherein the acute angle β ranges from 2° to 25°.

14. The cutter element of claim 13, wherein each acute angle β is the same.

15. The cutter element of claim 12, wherein the planar surface of each relief region is disposed at an acute angle θ measured upward from the planar surface to the plane, wherein the acute angle θ is greater than each acute angle β.

16. The cutter element of claim 15, the acute angle β ranges from 2° to 25° and the acute angle θ ranges from 2° to 40°.

17. The cutter element of claim 16, wherein each acute angle β is the same and each acute angle θ is the same.

18. The cutter element of claim 12, wherein each relief region intersects the planar central region along a linear edge.

19. The cutter element of claim 18, wherein each cutting region intersects the planar central region along a linear edge.

* * * * *